US012509945B2

(12) United States Patent
Bedouet

(10) Patent No.: US 12,509,945 B2
(45) Date of Patent: Dec. 30, 2025

(54) ROTARY STEERABLE SYSTEM

(71) Applicant: OnTarget Drilling, LLC, Houston, TX (US)

(72) Inventor: Sylvain Bedouet, Houston, TX (US)

(73) Assignee: OnTarget Drilling, LLC, Houston, TX (US)

( * ) Notice: Subject to any disclaimer, the term of this patent is extended or adjusted under 35 U.S.C. 154(b) by 0 days.

(21) Appl. No.: 18/619,405

(22) Filed: Mar. 28, 2024

(65) Prior Publication Data

US 2024/0263522 A1 Aug. 8, 2024

Related U.S. Application Data

(63) Continuation of application No. 17/682,503, filed on Feb. 28, 2022, now Pat. No. 11,970,942.

(Continued)

(51) Int. Cl.
*E21B 7/06* (2006.01)
*E21B 7/04* (2006.01)

(Continued)

(52) U.S. Cl.
CPC ..... *E21B 7/064* (2013.01); *E21B 7/04* (2013.01); *E21B 7/061* (2013.01); *E21B 7/067* (2013.01);

(Continued)

(58) Field of Classification Search
CPC . E21B 7/064; E21B 7/04; E21B 7/061; E21B 7/067; E21B 21/10; E21B 34/066; E21B 44/005

See application file for complete search history.

(56) References Cited

U.S. PATENT DOCUMENTS 1,083,004 A 12/1913 Davidson
4,637,479 A 1/1987 Leising (Continued)

FOREIGN PATENT DOCUMENTS

CA 2547036 A1 11/2006
CA 2170183 C 1/2007

(Continued)

OTHER PUBLICATIONS

Schlumberger, "NeoSteer CLx, Extreme curve and lateral at-bit steerable system," 2019.

(Continued)

*Primary Examiner* — Dany E Akakpo
(74) *Attorney, Agent, or Firm* — Jones Walker LLP

(57) ABSTRACT

A rotary steerable system including a steering section having at least one piston, at least one distribution flow passage extending from a valve to one of the pistons, and two main flow passages bypassing the pistons. At least a portion of each main flow passage is closer to a central point of the steering section than an outer boundary of the distribution flow passage. At least a portion of each main flow passage may also be closer to the central point of the steering section than an inner boundary of the pistons in a retracted position. The distribution flow passages are contained within a central area, with a ratio of a central area diameter to steering section diameter being 0.5 or less, preferably 0.4 or less. The steering section may include two piston sets and two distribution flow passages each extending from the valve to a piston.

9 Claims, 19 Drawing Sheets

Related U.S. Application Data

(60) Provisional application No. 63/207,487, filed on Mar. 2, 2021.

(51) Int. Cl.
*E21B 21/10* (2006.01)
*E21B 34/06* (2006.01)
*E21B 44/00* (2006.01)

(52) U.S. Cl.
CPC ..... *E21B 21/10* (2013.01); *E21B 34/066* (2013.01); *E21B 44/005* (2013.01)

(56) References Cited

U.S. PATENT DOCUMENTS

| | | | | |
|---|---|---|---|---|
| 5,186,264 | A | 2/1993 | Du Chaffaut | |
| 5,265,682 | A | 11/1993 | Russell et al. | |
| 5,520,255 | A | 5/1996 | Barr et al. | |
| 5,553,678 | A | 9/1996 | Barr et al. | |
| 5,582,259 | A | 12/1996 | Barr | |
| 5,695,015 | A | 12/1997 | Barr et al. | |
| 6,089,332 | A | 7/2000 | Barr et al. | |
| 6,467,557 | B1 | 10/2002 | Krueger et al. | |
| 7,057,316 | B2 | 6/2006 | Spring | |
| 7,133,325 | B2 | 11/2006 | Kotsonis et al. | |
| 7,141,901 | B2 | 11/2006 | Spring | |
| 7,378,985 | B2 | 5/2008 | Spring | |
| 7,503,405 | B2 | 3/2009 | Hall et al. | |
| 8,869,916 | B2 | 10/2014 | Clausen et al. | |
| 8,997,852 | B1 * | 4/2015 | Lee | E21B 43/12 166/105 |
| 9,016,400 | B2 | 4/2015 | Clausen et al. | |
| 9,187,956 | B2 | 11/2015 | Hutton et al. | |
| 9,624,727 | B1 | 4/2017 | Hutton | |
| 9,869,140 | B2 | 1/2018 | Rushton | |
| 2001/0052428 | A1 | 12/2001 | Larronde | |
| 2002/0011358 | A1 | 1/2002 | Wassell | |
| 2002/0112892 | A1 | 8/2002 | Taylor | |
| 2005/0056421 | A1 | 3/2005 | Homan et al. | |
| 2005/0109542 | A1 | 5/2005 | Downton | |
| 2006/0243487 | A1 | 11/2006 | Turner et al. | |
| 2006/0263215 | A1 | 11/2006 | Sindt et al. | |
| 2012/0061148 | A1 | 3/2012 | Clausen et al. | |
| 2012/0160565 | A1 | 6/2012 | Downton | |
| 2013/0118812 | A1 * | 5/2013 | Clausen | E21B 7/06 175/267 |
| 2016/0002978 | A1 | 1/2016 | Rushton | |
| 2018/0128060 | A1 | 5/2018 | Haugvaldstad | |
| 2020/0080381 | A1 | 3/2020 | Hardin, Jr. | |
| 2020/0318437 | A1 | 10/2020 | Gray | |
| 2020/0325731 | A1 * | 10/2020 | Chambers | E21B 7/068 |
| 2021/0198949 | A1 | 7/2021 | Haugvaldstad et al. | |

FOREIGN PATENT DOCUMENTS

| | | | |
|---|---|---|---|
| CN | 105239924 | A | 1/2016 |
| GB | 2426265 | A | 11/2006 |
| WO | 2002091553 | A1 | 11/2002 |
| WO | 2019190484 | A1 | 10/2019 |
| WO | 2020018816 | A1 | 1/2020 |

OTHER PUBLICATIONS

Schlumberger, "PowerDrive Orbit, Rotary steerable system," 2016.
Scientific Drilling, Halo Technical Data Sheet, 2018.
Dexter Magnetic Technologies, Inc., "Final Report: Development of a High Pressure/High Temperature Don-hole Turbine Generator," Oil & Natural Gas Technology, 2010.
D-Tech Rotary Steerable, "D-Tech RST—Engineered for Maximum Performance Through Superior Reliability," 2020.
Halliburton, "iCruise® Intelligent Rotary Steerable System," 2019.
Application (including specification, drawings, and claims) from applicant's co-pending U.S. Appl. No. 18/463,687, filed Sep. 8, 2023, titled "Modular Rotary Steerable System.".
Wang, Li, Wang, Huang, Fan, Luo, Zhang, Zhang, and Shi, "Prediction Model of Build Rate of Push-the-Bit Rotary Steerable System," Hindawi, Mathematical Problems in Engineering, vol. 2020, Article ID 4673759, May 22, 2020.

* cited by examiner

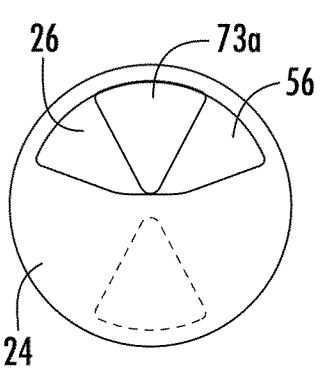
FIG. 23A
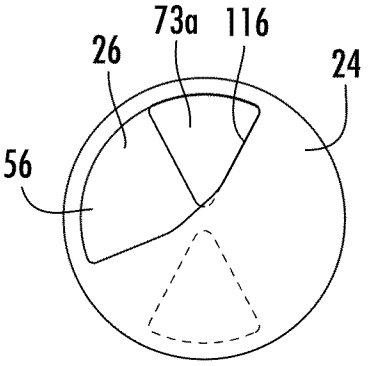
FIG. 23B
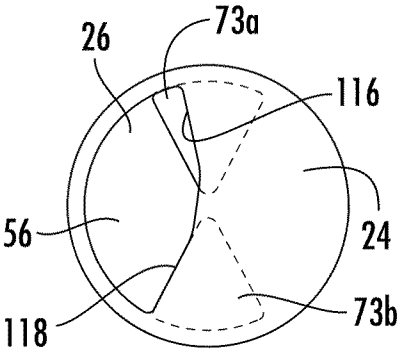
FIG. 23C
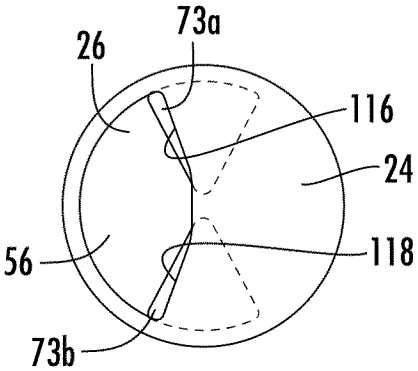
FIG. 23D
FIG. 23E
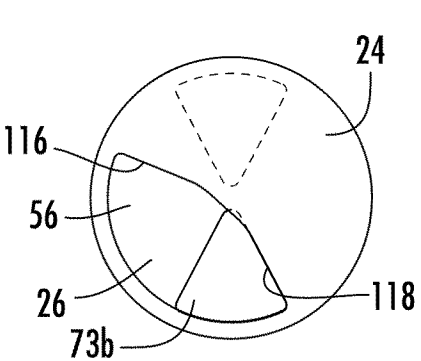
FIG. 23F
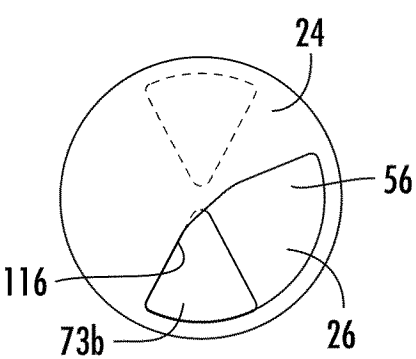
FIG. 23G
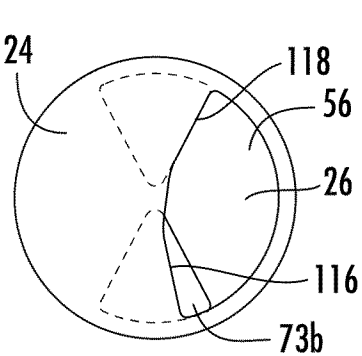
FIG. 23H

ROTARY STEERABLE SYSTEM

CROSS-REFERENCE TO RELATED APPLICATION

This application is a continuation of U.S. patent application Ser. No. 17/682,503, filed on Feb. 28, 2022, which claims the benefit of, and priority to, U.S. Provisional Patent Application No. 63/207,487, filed on Mar. 2, 2021, both of which are incorporated herein by reference.

BACKGROUND

In the process of drilling and producing oil and gas wells, rotary steerable systems are used to control and adjust the direction in which a well is drilled. Conventional rotary steerable systems are well over 150 inches in length and include three or more sets of extending pistons. These large systems require frequent maintenance. The conventional rotary steerable systems' long length presents challenges in the maintenance, including transporting the system from a drilling location to a shop.

BRIEF DESCRIPTION OF THE DRAWING VIEWS

FIGS. 23A-23L are schematic views of the valve assembly with the valve rotor in a sequence of positions as it rotates relative to the valve stator.

DETAILED DESCRIPTION OF SELECTED EMBODIMENTS

Disclosed herein is a rotary steerable system including a steering section. The steering section includes at least one piston. In some embodiments, the steering section includes only two pistons in each transverse cross-sectional plane. A center point of a first piston is separated from a center point of a second piston by an angle greater than 120 degrees.

The rotary steerable system also includes a valve assembly configured to direct a portion of a drilling fluid flowing through the rotary steerable system into a distribution flow passage, thereby activating one of the pistons and causing the piston to extend in a radially outward direction. A ratio of the diameter of each distribution flow passage to the steering section diameter is at least 0.07. The distribution flow passages are contained within a central area of the steering section. A ratio of the diameter of the central area to the steering section diameter is 0.5 or less. An activation duration of each set of pistons is about 180 degrees of rotation of a valve rotor. A ratio of the stroke length of each piston to the diameter of the steering section is greater than 0.06. As used herein, "diameter of the steering section" and "steering section diameter" both mean the minimum outer diameter of any portion of the assembled steering section (i.e., the outer diameter of the smallest portion of the assembled steering section). For example, in some embodiments, the steering section diameter may be the outer diameter of steering housing 22.

In some embodiments, the rotary steerable system also includes a control section. A combined length of the control section and the steering section is below 150 inches, preferably below 80 inches.

FIGS. 1-37 illustrate embodiments of the rotary steerable system disclosed herein, with many other embodiments within the scope of the claims being readily apparent to skilled artisans after reviewing this disclosure.

Figure 1:
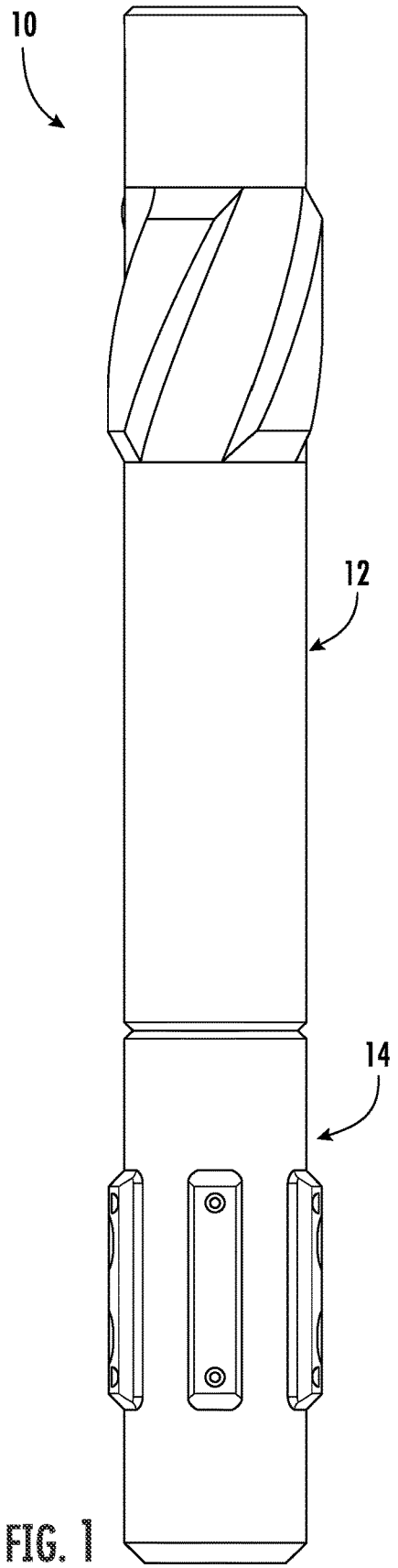
FIG. 1 is a side view of a rotary steerable system of the present invention.
Figure 2:
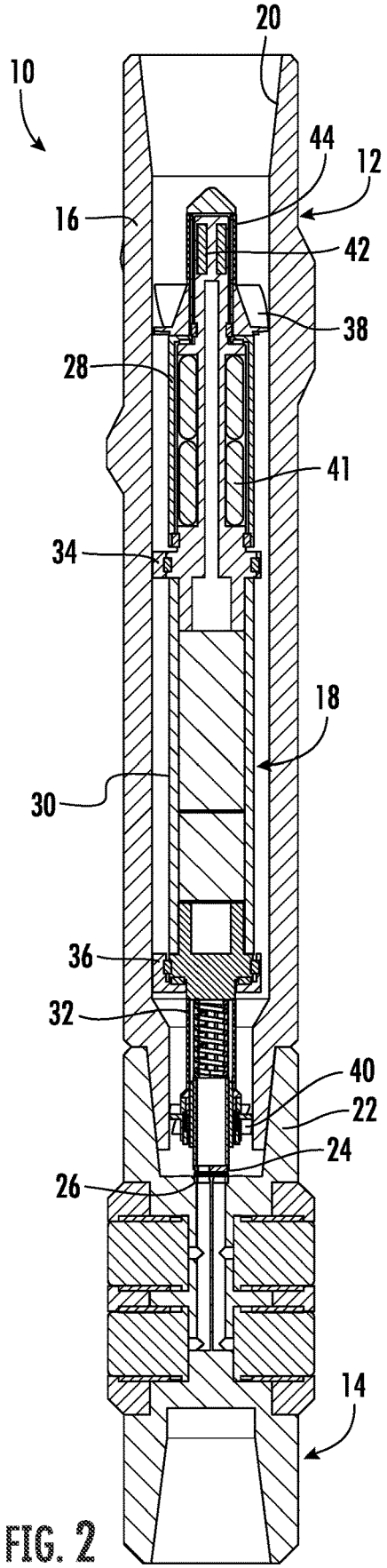
FIG. 2 is a sectional view of the rotary steerable system.
Figure 3:
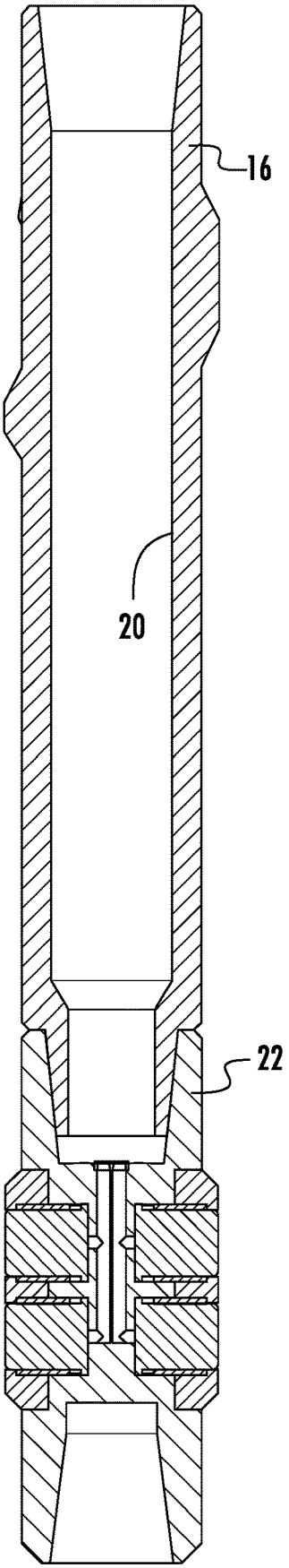
FIG. 3 is a sectional view of a control sleeve and a steering section of the rotary steerable system.

With reference to FIGS. 1-3, rotary steerable system 10 includes control section 12 and steering section 14, each having a generally cylindrical shape. Control section 12 includes electronic components, sensors, and actuators for determining a drilling direction or tool face required and for orienting the steering section.

Control section 12 includes control sleeve 16 and control insert 18 disposed within inner bore 20 of control sleeve 16. Control insert 18 is configured for rotation relative to control sleeve 16. In one embodiment, control insert 18 is configured to remain stationary with respect to a surrounding subterranean formation, such that control sleeve 16 rotates around control insert 18. In other words, control insert 18 may be configured to remain geo-stationary. A lower end of control sleeve 16 is secured to an upper end of steering housing 22 of steering section 14. In this way, control sleeve 16 is rotationally secured to steering housing 22. As used herein, "rotationally secured" means secured together such that two components rotate together (i.e., there is no relative rotation between two components under normal operating conditions).

A lower end of control insert 18 includes a valve rotor 24, which cooperates with valve stator 26 secured to steering housing 22. Valve rotor 24 rotates relative to valve stator 26 as control insert 18 rotates relative to control sleeve 16 and steering housing 22.

Referring now to FIGS. 2 and 4-6, control insert 18 may include upper control unit 28, electronics unit 30, and lower control unit 32. Control insert 18 may also include guide 34 secured to upper control unit 28 and guide 36 secured to lower control unit 32. Guide 34 and 36 may be rotationally secured to control sleeve 16, while upper and lower control units 28 and 32 rotate within guides 34 and 36, respectively. Control insert 18 may further include upper impeller 38 rotationally secured to upper control unit 28 and lower impeller 40 rotationally secured to lower control unit 32. Upper and lower impellers 38 and 40 may be sized and configured such that the outer ends of impellers 38 and 40 are in close proximity a surface of inner bore 20 of control sleeve 16. Guides 34 and 36 and impellers 38 and 40 may stabilize a position of control insert 18 within inner bore 20 of control sleeve 16 while control insert 18 therein.

Referring again to FIG. 2, upper control unit 28 may include a magnetic brake 41, which functions as an actuator to apply rotational torque in a direction that is opposite to a rotational direction of control sleeve 16 and steering housing 22. In this way, the magnetic brake assembly adjusts the rotation rate of control insert 18 relative to control sleeve 16. As a drilling fluid flows through inner bore 20 of control sleeve 16, the drilling fluid flows through spaces in impeller 38, thereby applying a rotational force on impeller 38 and upper control unit 28. In one embodiment, upper control unit 28 also includes a power generation mechanism. The magnetic brake assembly may be the only actuator in rotary steerable system 10.

Figure 4:
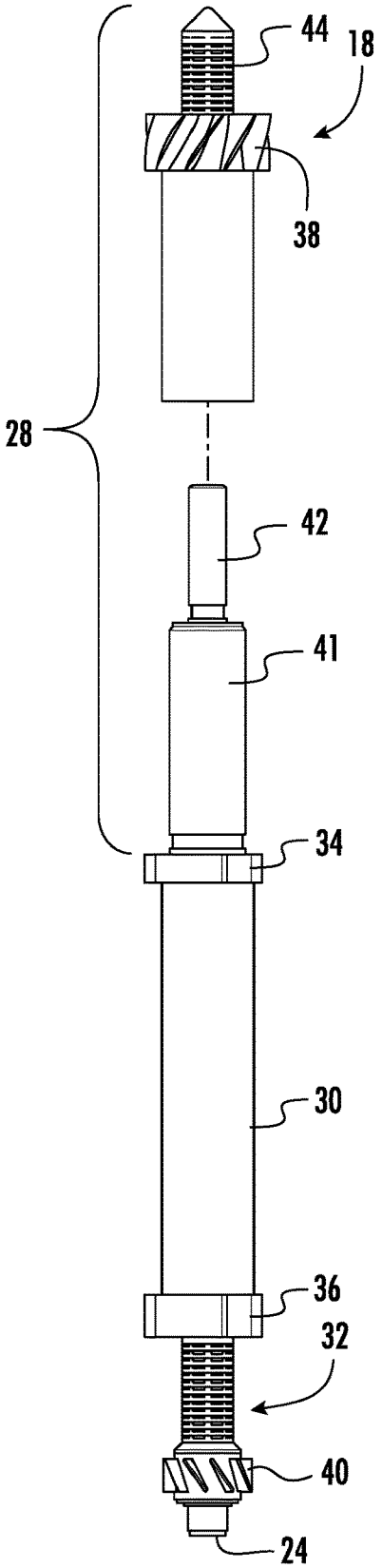
FIG. 4 is a partially exploded view of a control insert configured to fit within the control sleeve.
Figure 5:
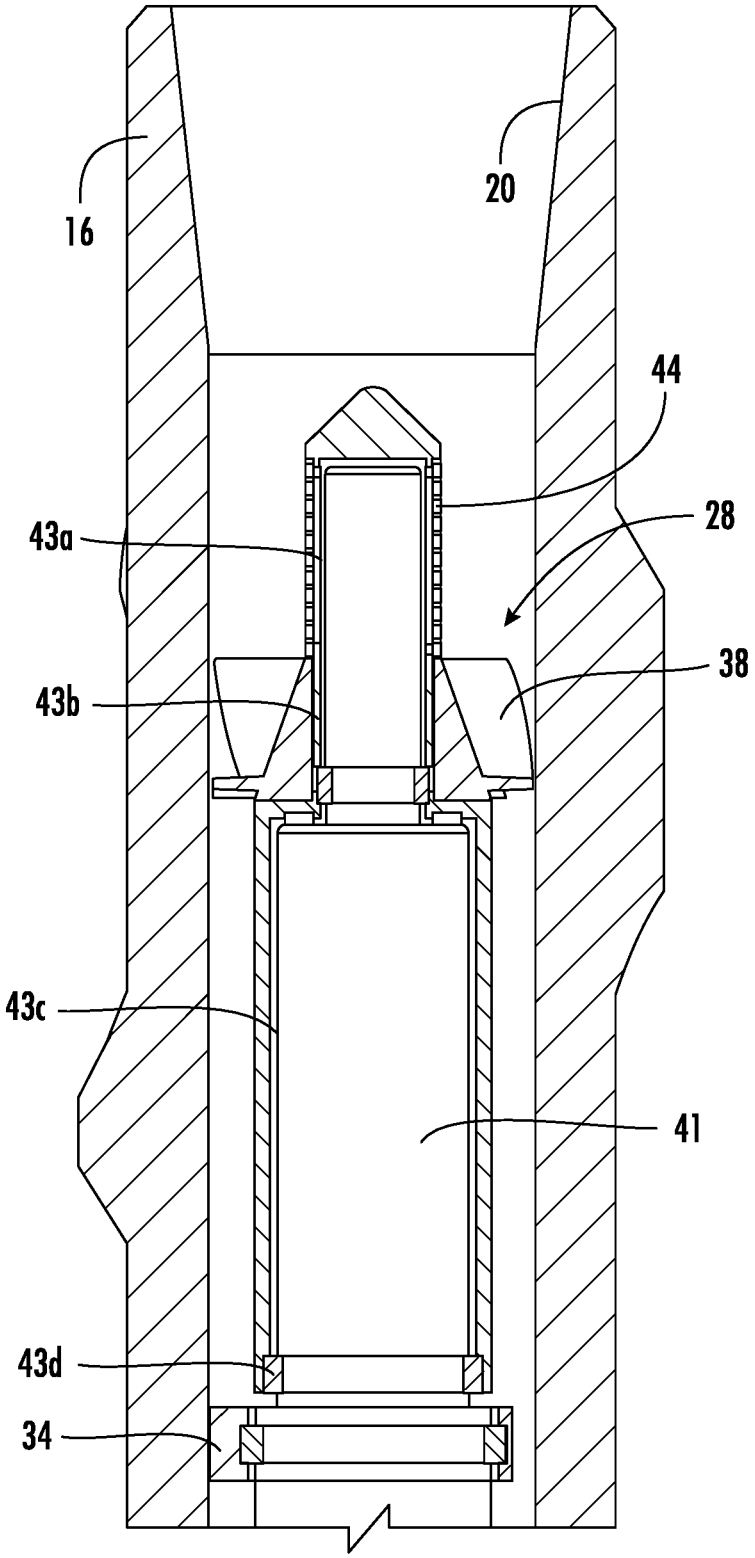
FIG. 5 is a partial sectional view of an upper control unit of the control insert within the control sleeve.

With reference to FIGS. 4 and 5, upper control unit 28 may also include upper filter 44. In one embodiment, upper filter 44 may be formed of rings with shoulders such that the stacking of the rings creates small interstices that function to filter. As drilling fluid flow through inner bore 20 of control sleeve 16, a small amount of drilling fluid may flow through upper filter 44 and through intermediate spaces 43*a*, 43*b*, 43*c*, and 43*d* surrounding antenna 42 and magnetic brake 41. Upper filter 44 removes larger particles from the drilling fluid to allow a small amount of clean fluid to flow in the intermediate spaces 43*a*-43*d*. Allowing only clean fluid to flow in intermediate spaces 43*a*-43*d* prevents the two parts of upper control unit 28 from seizing up and/or from creating additional drag between the two parts of upper control unit 28. The majority of the drilling fluid flows around the exterior surface of filter 44 and through the spaces in impeller 38.

Electronics unit 30 may include sensors. For example, electronics unit 30 may include a magnetometer for sensing a north-south direction, an accelerometer for sensing inclination, and a gyrometer for sensing rotation of the control unit relative to a surrounding subterranean formation. Control insert 18 may be configured to adjust the magnetic brake assembly in the upper control unit 28 based on measurements taken by the sensors in electronics unit 30. In some embodiments, the rotary steerable system 10 includes no batteries and only a small amount of memory (e.g., flash memory only). In these embodiments, the electronics unit 30 may include antenna 42 for transmitting measurement data and other data to a measurement-while-drilling ("MWD") unit secured above the rotary steerable system 10, and the MWD unit may store the received data in a memory. Antenna 42 of the electronics unit 30 may be formed of an electromagnetic antenna.

Figure 6:
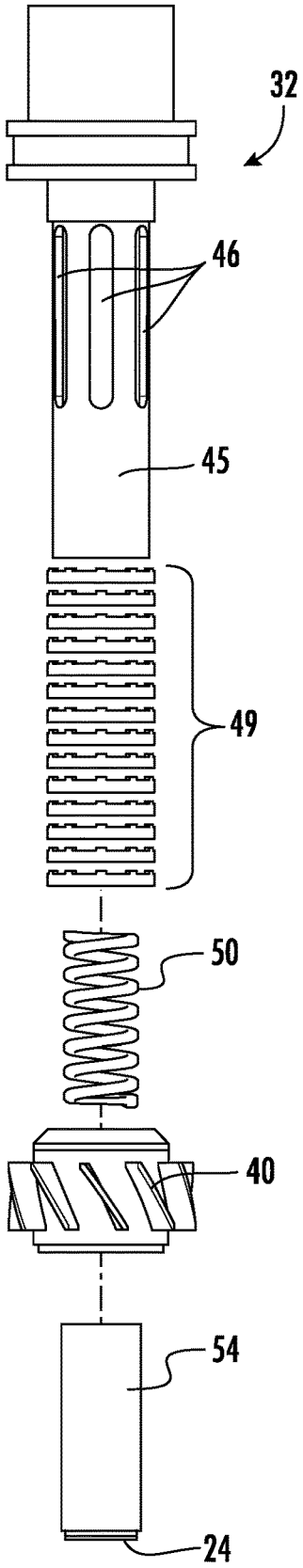
FIG. 6 is an exploded view of a lower control unit of the control insert.
Figure 7:
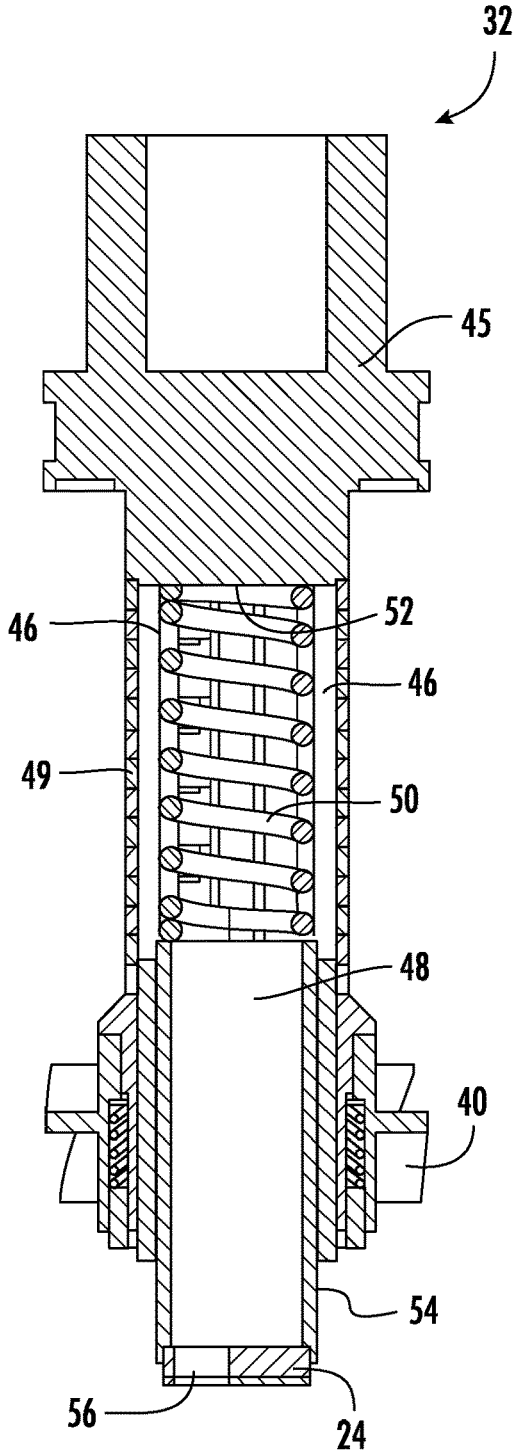
FIG. 7 is a sectional view of the lower control unit of the control insert.

With reference to FIGS. 6 and 7, lower control unit 32 may include housing 45 with flow passages 46. Flow passages 46 are configured to allow a drilling fluid in an annular space between control sleeve 16 and housing 45 to flow into inner space 48 within housing 45. Lower control unit 32 may also include lower filter 49 configured to surround and cover flow passages 46 in order to filter drilling fluid as it flows through flow passages 46 and enters inner space 48. In one embodiment, lower filter 49 may be formed of rings with shoulders such that the stacking of the rings creates small interstices that function to filter. Lower control unit 32 may further include spring 50 disposed within inner space 48 and configured to bias valve rotor 24 in a direction toward the valve stator 26 and steering section 14. For example, an upper end of spring 50 may engage transverse surface 52 of housing 45, while lower end of spring 50 engages an upper end of spacer 54 to apply a downward force on the valve rotor 24, which is secured to a lower end of spacer 54. As a drilling fluid flows through the annular space between control sleeve 16 and housing 45, a portion of the drilling fluid may flow through flow passages 46, into inner space 48, and through a rotor port 56 of valve rotor 24. The remainder of the drilling fluid flowing through the annular space may flow through spaces in impeller 40 outside of housing 45.

Figure 8:
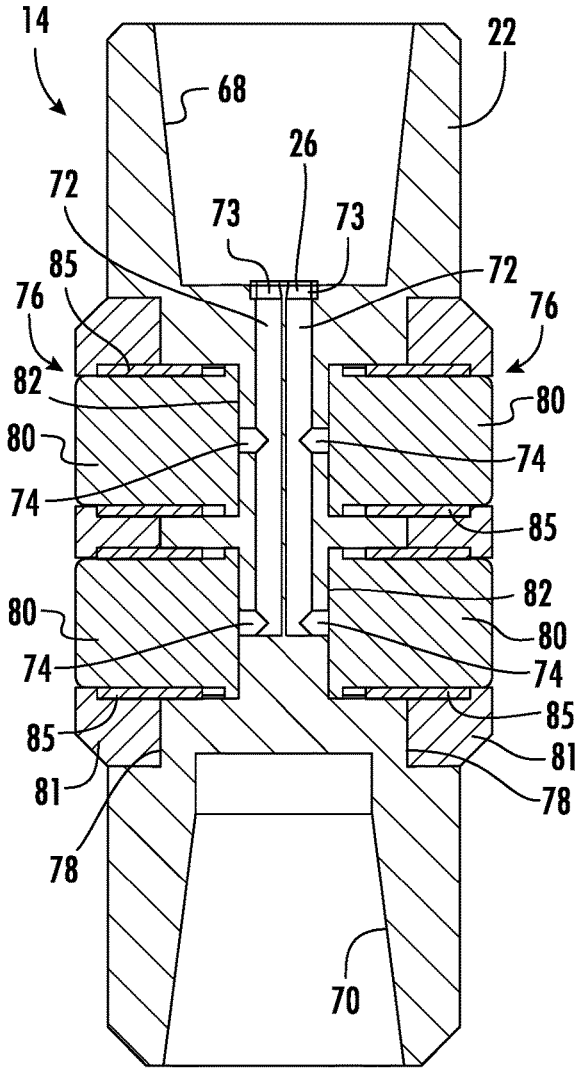
FIG. 8 is a sectional view of the steering section.
Figure 9:
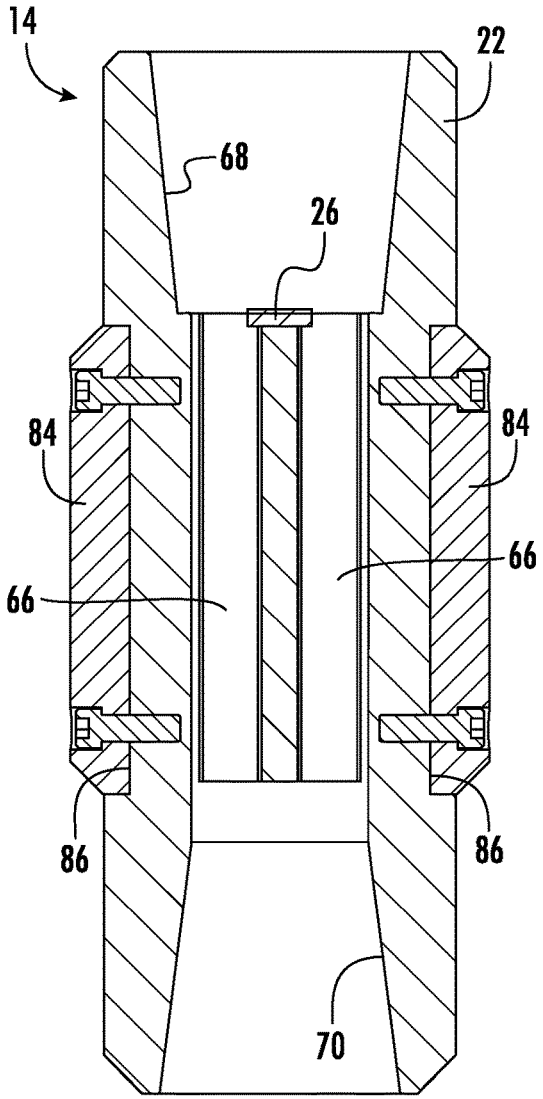
FIG. 9 is a sectional view of the steering section taken along a perpendicular plane as compared to FIG. 8.

With reference now to FIGS. 8 and 9, steering section 14 includes parallel main flow passages and distribution flow passages. Steering housing 22 includes two main flow passages 66 extending from upper inner bore 68 to lower inner bore 70. Steering housing 22 also includes two distribution flow passages 72, each extending from a stator port 73 of valve stator 26 to one or more feed channels 74. Steering section 14 also includes two piston assemblies 76, each at least partially secured within a receptacle 78 in an outer surface of steering housing 22. Each piston assembly 76 includes one or more pistons 80 each disposed within a piston sleeve 85, all disposed within piston clamp 81, which is configured to be secured within piston receptacle 82 in steering housing 22. Pistons 80 are configured to slide in a radial direction within piston receptacles 82. Each feed channel 74 extends from a distribution flow passage 72 to a piston receptacle 82. Steering section 14 of rotary steerable system 10 may include not more than two pistons in each transverse cross-sectional plane, with the center points of the pistons separated by an angle greater than 120 degrees. Steering section 14 may include not more than two sets of pistons.

Steering section 14 may further include spacers 84, each at least partially disposed within spacer receptacles 86 in an outer surface of steering housing 22. In one embodiment, spacers 84 are secured to steering housing 22 using bolts or screws. As used herein, "piston" means any structure configured to extend, when activated, in a radial direction from a tool to which it is secured or in which it is incorporated. For example, "piston" includes a pad, a wedge arrangement, and a cam arrangement.

Figure 10:
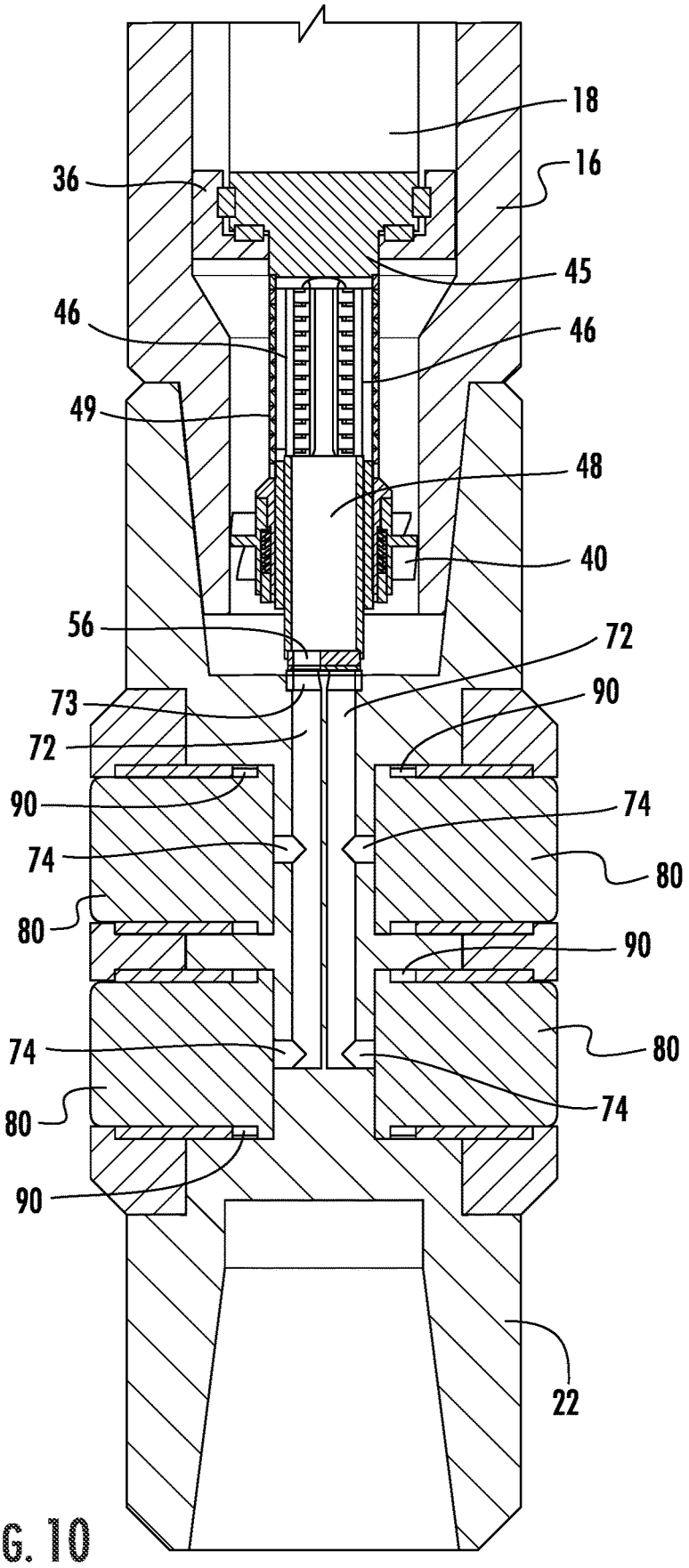
FIG. 10 is a sectional view of a lower portion of the control section and the steering section.

Referring to FIG. 10, as a drilling fluid flows through the annular space between control sleeve 16 and control insert 18, a portion of the drilling fluid may flow through flow passages 46 and into inner space 48 of housing 45. The drilling fluid within inner space 48 may flow through rotor port 56 of valve rotor 24 and through a stator port 73 of valve stator 26 that is aligned with rotor port 56. As valve rotor 24 rotates relative to valve stator 26, rotor port 56 aligns with each of the stator ports 73 in sequence over time. Accordingly, the drilling fluid flowing through rotor port 56 will flow through each of the stator ports 73 in sequence over time. Drilling fluid that flows through one of the stator ports 73 flows through the connecting distribution flow passage 72, through each of the connected feed channels 74, and into connected piston receptacles 82 in order to apply a force and displace piston 80 in a radial outward direction. In some embodiments, and in order to provide an exhaust path for when the piston retracts from an open position, the drilling fluid can flow through leak channels 90 between pistons 80 and piston receptacles 82, or in another embodiment, it may leak between the piston and the guide sleeve, through diametral space between the two or through a channel formed in the sleeve or in the piston that connect piston receptacles 82 to the wellbore. In another embodiment, the leak channels may be located through the piston body to connect piston receptacles 82 to the wellbore. In another embodiment, the leak channel may be located between the guide sleeve and the steering body.

Figure 13:
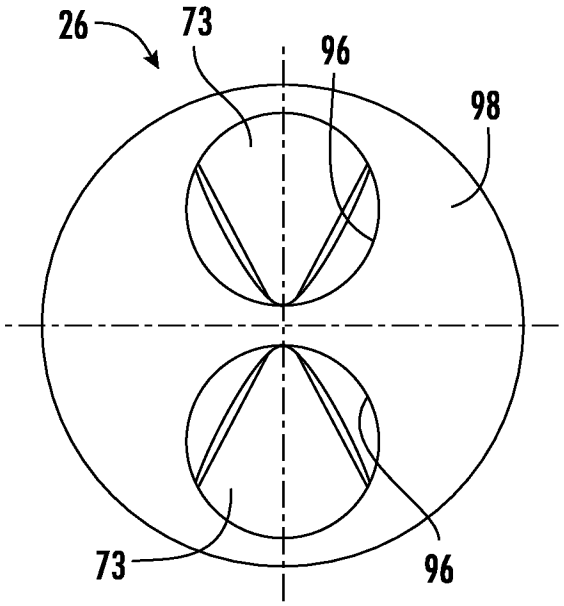
FIG. 13 is bottom view of the valve stator of the rotary steerable system.
Figure 12:
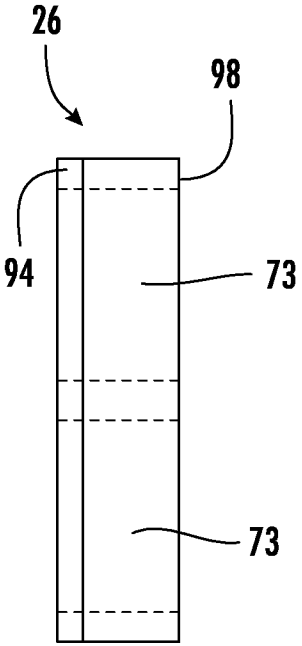
FIG. 12 is a sectional view of the valve stator of the rotary steerable system taken along line 12-12 in FIG. 11.
Figure 11:
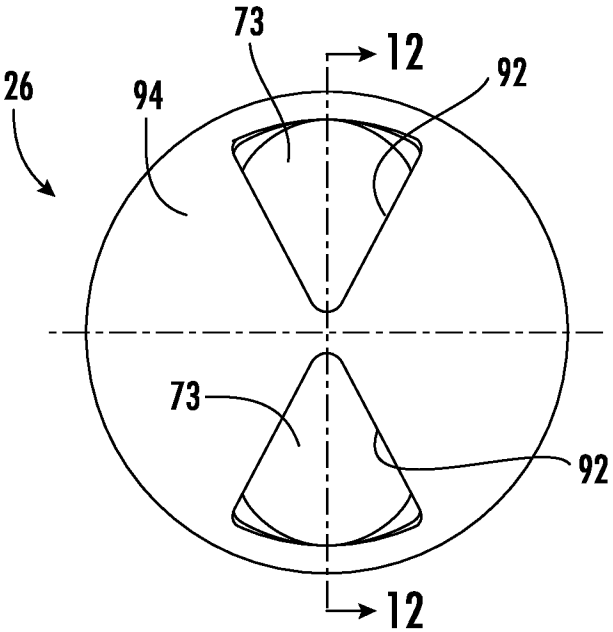
FIG. 11 is a top view of a valve stator of the rotary steerable system.

FIGS. 11-13 illustrate one embodiment of valve stator 26, which includes two stator ports 73 positioned on opposite sides of valve stator 26. In other words, the central point of the outer boundary of one stator port 73 is 180 degrees from the central point of the outer boundary of the second stator port 73. In this embodiment, the shape of each stator port 73 varies across the thickness of valve stator 26. For example, each stator port 73 may be defined by a wedge-shaped opening 92 on first side 94 of valve stator 26 and defined by a circular opening 96 on second side 98 of valve stator 26. First side 94 is configured to engage valve rotor 24, and second side 98 is configured to engage distribution flow passages 72. The sides of the wedge-shaped opening 92 may be formed of straight lines, which align with side boundaries of rotor port 56 to provide sharper actuations of pistons. While the circular openings 96 are configured to align with the distribution flow passages 72. The transition of the shape of stator ports 73 across the thickness of valve stator 26 reduces the length of transition flow lines needed between the valve assembly and the pistons 80. In other embodiments, each stator port 73 may be defined by wedge-shaped opening 92 on first side 94 of valve stator 26 and defined by a polygon-shaped opening on second side 98 of valve stator 26. In still other embodiments, stator ports 73 may have the same shape across the thickness of valve stator 26.

Figure 16:
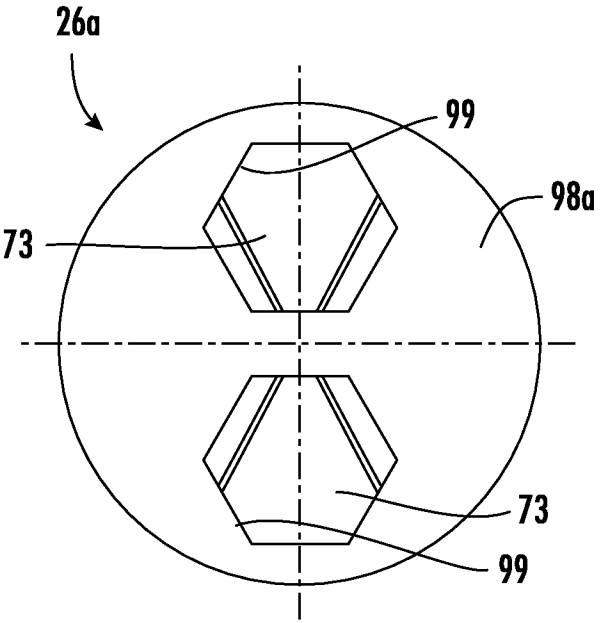
FIG. 16 is bottom view of the alternate embodiment of the valve stator of the rotary steerable system.
Figure 15:
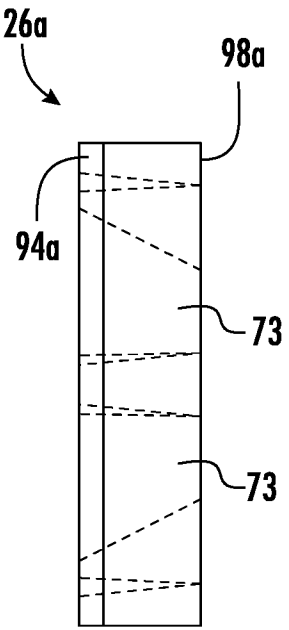
FIG. 15 is a sectional view of the alternate embodiment of the valve stator of the rotary steerable system taken along line 15-15 in FIG. 14.
Figure 14:
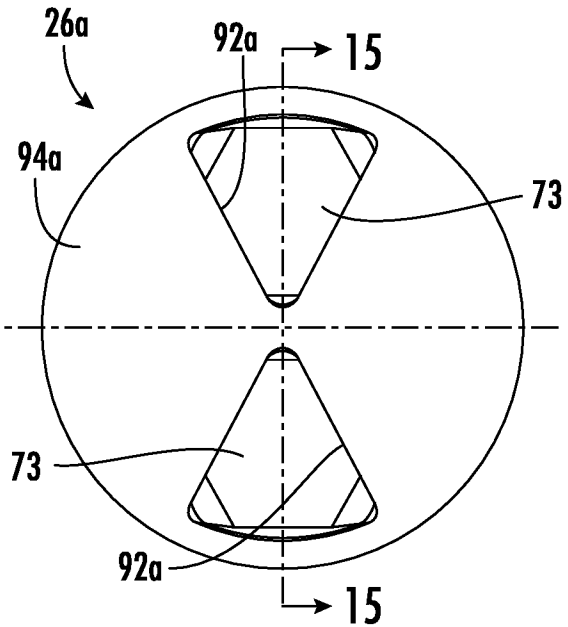
FIG. 14 is a top view of an alternate embodiment of the valve stator of the rotary steerable system.

FIGS. 14-16 illustrate an alternate embodiment of valve stator 26*a*. In this embodiment, each stator port 73 is defined by a wedge-shaped opening 92*a* on first side 94*a* of valve stator 26*a*. Each stator port 73 is defined by a polygon-shaped opening 99 on second side 98*a* of valve stator 26*a*.

Figure 19:
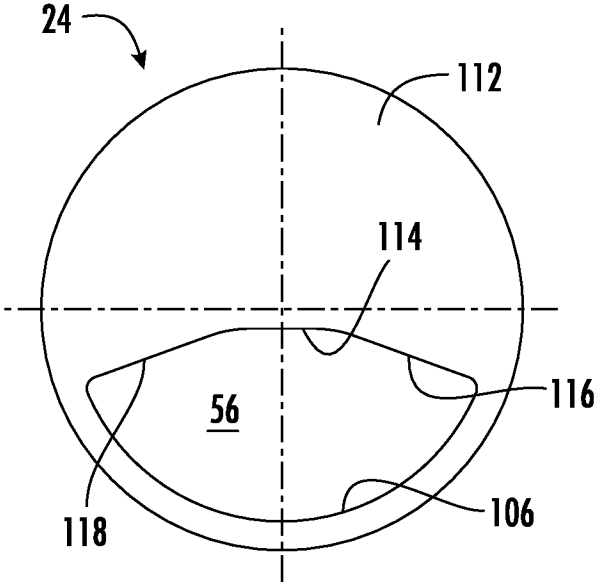
FIG. 19 is bottom view of the valve rotor of the rotary steerable system.
Figure 18:
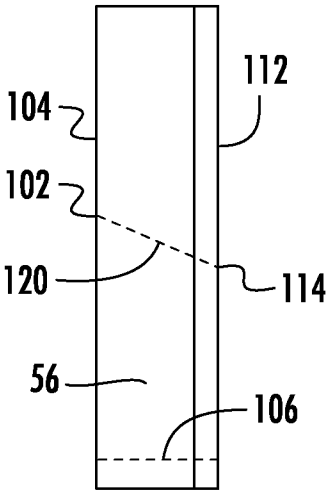
FIG. 18 is a sectional view of the valve rotor of the rotary steerable system taken along line 18-18 in FIG. 17.
Figure 17:
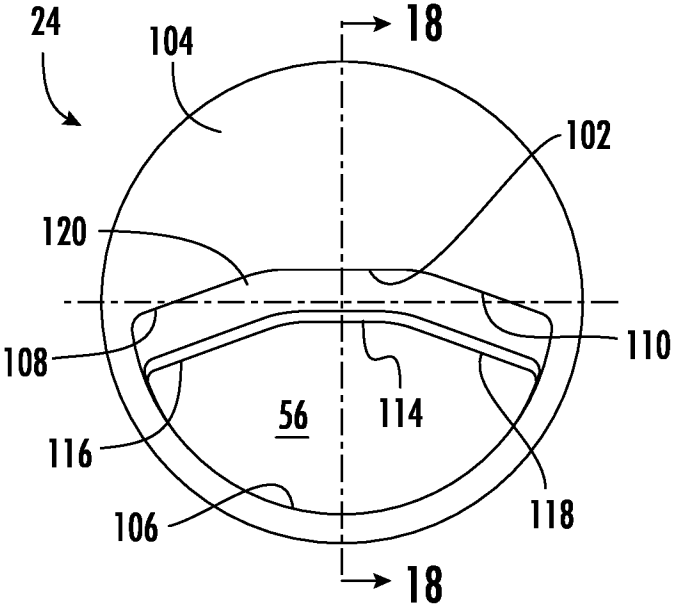
FIG. 17 is a top view of a valve rotor of the rotary steerable system.

FIGS. 17-19 illustrate one embodiment of valve rotor 24, which includes only one rotor port 56. In this embodiment, the shape of rotor port 56 varies across the thickness of valve rotor 24. For example, rotor port 56 may be defined by inner boundary 102, outer boundary 106, and side boundaries 108 and 110 on first side 104 of valve rotor 24. Side boundaries 108 and 110 interconnect inner and outer boundaries 102 and 106 on first side 104. A center point of first side 104 is positioned between inner boundary 102 and outer boundary 106. In other words, rotor port 56 includes the center point of first side 104. Inner boundary 102 of rotor port 56 remains constant throughout the thickness of valve rotor 24. On second side 112 of valve rotor 24, rotor port 56 may be defined by outer boundary 106, inner boundary 114, and side boundaries 116 and 118. Side boundaries 116 and 118 interconnect inner and outer boundaries 102 and 106 on second side 112. Inner boundary 114 is positioned between outer boundary 106 and a center point of second side 112. In other words, the center point of second side 112 is not included within rotor port 56. Valve rotor 24 may include sloped surface 120 in the transitions between inner boundaries 102 and 114, side boundaries 108 and 116, and side boundaries 110 and 118, respectively.

Side boundaries 116 and 118 of first side 104 of rotor port 56 may have the same shape as the side boundaries of wedge-shaped openings 92 of stator ports 73. For example, each of the side boundaries 116 and 118 and each of the side boundaries of wedge-shaped openings 92 may be formed of a straight line extending in a radial direction.

Figure 21:
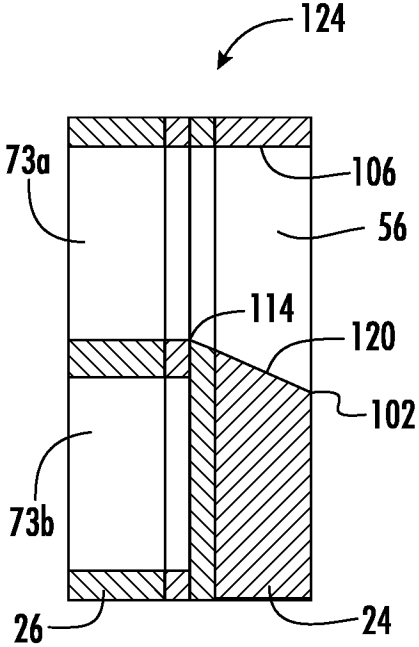
FIG. 21 is a sectional view of the valve assembly with the valve rotor in the first position taken along line 21-21 in FIG. 20.
Figure 20:
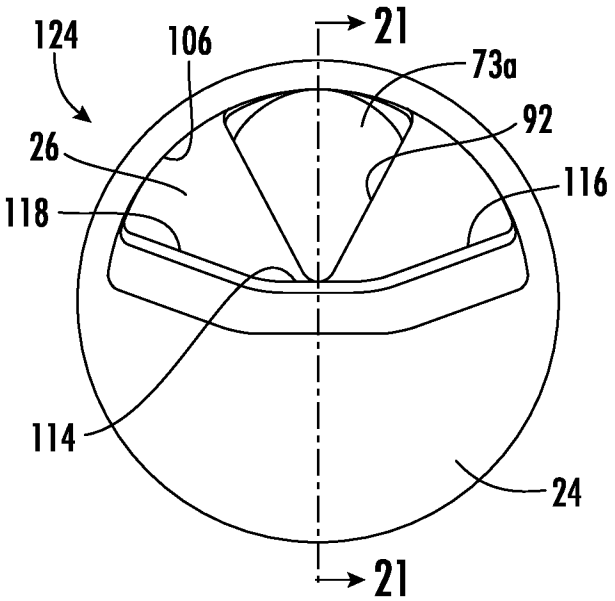
FIG. 20 is a top view of the valve assembly including the valve rotor and the valve stator, with the valve rotor in a first position.
Figure 22:
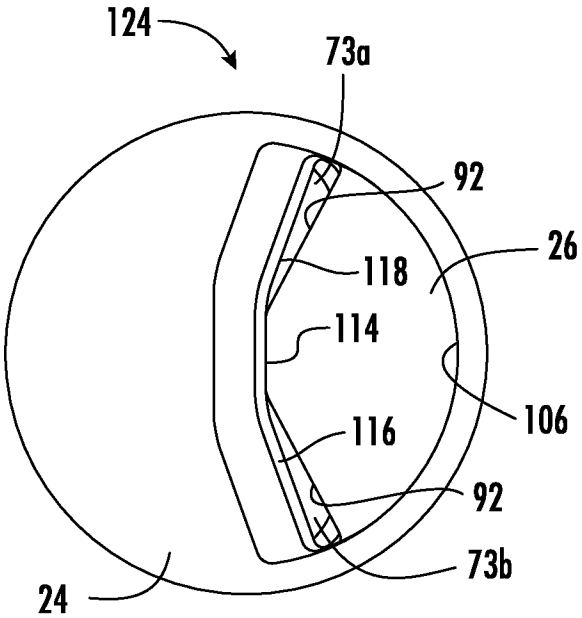
FIG. 22 is a top view of the valve assembly with the valve rotor in a second position.

Referring now to FIGS. 20-22, valve assembly 124 may include valve rotor 24 and valve stator 26, with valve rotor 24 rotating relative to valve stator 26. In this embodiment, outer boundary 106 of rotor port 56 aligns with the outer boundary of wedge-shaped openings 92 of stator ports 73, and inner boundary 114 of rotor port 56 aligns with the inner boundary of wedge-shaped openings 92 of stator ports 73. In a first position shown in FIGS. 20 and 21, rotor port 56 is aligned with all of the wedge-shaped opening 92 of a single stator port 73. In this first position, a first stator port 73*a* is "open" and a second stator port 73*b* (not shown in this view) is "closed." As valve rotor 24 rotates, the side boundaries 116 and 118 of rotor port 56 cross over the side boundaries of wedge-shaped openings 92 of stator ports 73, thereby alternately opening and closing stator ports 73*a* and 73*b*. The angular separation of side boundary 116 from side boundary 118 and the angular separation of the two side boundaries of each wedge-shaped opening 92 together define the duration for which each stator port 73 is open (i.e., activation duration of each stator port 73). These angular separations also define whether both stator ports 73 are partially open at a single point in time, and if so, the duration for which both stator ports 73 are simultaneously partially open. In certain embodiments, the opening angle of the rotor port 56 (i.e., the angular distance between side boundaries 116 and 118 within rotor port 56) is at least 110 degrees. As used herein, "opening angle" is the rotational distance between two radial boundaries within an opening. In some embodiments, the side boundaries of the two wedge-shaped openings 92 are separated by at least 110 degrees or between 110 degrees and 170 degrees, or any subrange therein. In certain embodiments, the side boundaries of the two wedge-shaped openings 92 are separated by at least 125 degrees. In further embodiments, the side boundaries of the two wedge-shaped openings 92 are separated by an angle between 140 degrees and 170 degrees. In a second position shown in FIG. 22, rotor port 56 is aligned with a portion of stator port 73*a* and a portion of stator port 73*b*.

Figure 23L:
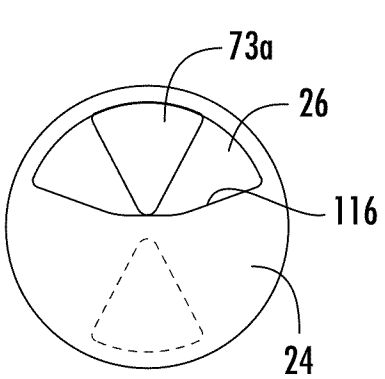

FIGS. 23A-23L illustrate valve assembly 124 with valve rotor 24 in various sequential positions relative to valve stator 26 over time. In this embodiment, valve rotor 24 rotates in a counter-clockwise direction. In other embodiments, valve rotor 24 rotates in a clockwise direction. In still other embodiments, valve rotor 24 is maintained in a geostationary position while valve stator 26 rotates with steering section 14 and control sleeve 16 in a clockwise direction. FIG. 23A illustrates the first position shown in FIGS. 20 and 21, in which rotor port 56 is aligned with first stator port 73*a* such that first stator port 73*a* is fully open and second stator port 73*b* is closed. First stator port 73*a* remains fully open through the time when side boundary 116 of rotor port 56 aligns with a side boundary of the wedge-shaped opening of first stator port 73*a*, as shown in FIG. 23B.

As shown in FIG. 23C, further rotation of valve rotor 24 causes side boundary 116 of rotor port 56 to move across first stator port 73*a* thereby reducing the open cross-sectional area of first stator port 73*a* and reducing the fluid flow rate through first stator port 73*a*. The first stator port 73*a* is partially open and the second stator port 73*b* is closed through the time when side boundary 118 of rotor port 56 aligns with a first side boundary of the wedge-shaped opening of second stator port 73*b*, as shown in FIG. 23C. Further rotation of valve rotor 24 causes side boundary 118 of rotor port 56 to move past the first side boundary of second stator port 73*b*, thereby placing both first and second stator ports 73*a* and 73*b* in partially open positions, as shown in FIG. 23D. In this embodiment, the valve assembly is configured to have first and second stator ports 73*a* and 73*b* partially open simultaneously as shown in FIG. 23D. The valve assembly remains in this simultaneous partially open position until side boundary 116 aligns with a second side boundary of first stator port 73*a* to place first stator port 73*a* in the closed position, as shown in FIG. 23E. As valve rotor 24 rotates further and side boundary 118 of rotor port 56 moves across the second stator port 73*b*, second stator port 73*b* is further opened and the fluid flow rate through the second stator port 73*b* increases. During this time, first stator port 73*a* is closed and second stator port 73*b* is partially open.

As shown in FIG. 23F, second stator port 73*b* is placed in a fully open position when side boundary 118 of rotor port 56 aligns with a second side boundary of second stator port 73*b*. Second stator port 73*b* remains in the fully open position through the time when side boundary 116 of rotor port 56 aligns with the first side boundary of second stator port 73*b* as shown in FIG. 23G.

Figure 23K:
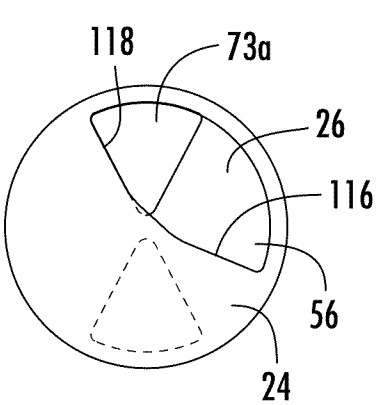
Figure 23J:
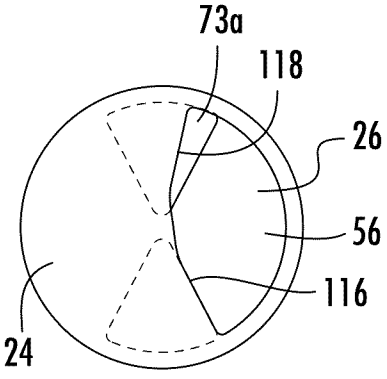
Figure 23I:
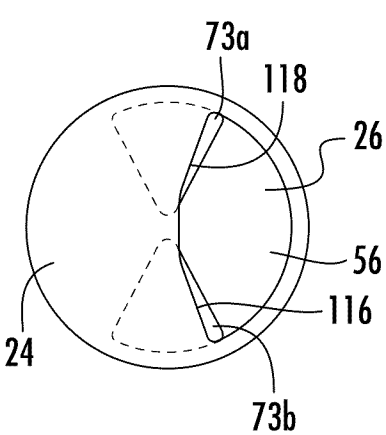

As shown in FIG. 23H, further rotation of valve rotor 24 causes side boundary 116 of rotor port 56 to move across second stator port 73*b*, thereby reducing the open cross-sectional area of second stator port 73*b* and reducing the fluid flow rate therethrough. The first stator port 73*a* is closed and the second stator port 73*b* is partially open through the time when side boundary 118 of rotor port 56 aligns with the first side boundary of first stator port 73*a*, as shown in FIG. 23H. Further rotation of valve rotor 24 causes side boundary 118 of rotor port 56 to move past the first side boundary of first stator port 73*a* to place both stator ports 73*a* and 73*b* in partially open positions, as shown in FIG. 23I. The valve assembly remains in this simultaneous partially open position until side boundary 116 of rotor port 56 aligns with the second side boundary of second stator port 73*b* to place second stator port 73*b* in the closed position, as shown in FIG. 23J. As valve rotor 24 continues to rotate and side boundary 118 of rotor port 50 moves across the first stator port 73*a*, first stator port 73*a* is further opened and the fluid flow rate through the first stator port 73*a* increases. During this time, first stator port 73*a* is partially open and second stator port 73*b* is closed. As shown in FIG. 23K, first stator port 73*a* is placed in the fully open position when side boundary 118 of rotor port 56 aligns with the second side boundary of first stator port 73*a*. FIG. 23L again illustrates the valve assembly in the first position, in which first stator port 73*a* is fully open and second stator port 73*b* is closed. Table 1 lists the positions of the stator ports in each view of FIG. 23.

TABLE 1

| FIG. | Position of First stator port 73a | Position of Second stator port 73b |
|---|---|---|
| FIG. 23A | Fully open | Closed |
| FIG. 23B | Fully open | Closed |
| FIG. 23C | Partially open | Closed |
| FIG. 23D | Partially open | Partially open |
| FIG. 23E | Closed | Partially open |
| FIG. 23F | Closed | Fully open |
| FIG. 23G | Closed | Fully open |
| FIG. 23H | Closed | Partially open |
| FIG. 23I | Partially open | Partially open |
| FIG. 23J | Partially open | Closed |
| FIG. 23K | Fully open | Closed |
| FIG. 23L | Fully open | Closed |

The theoretical activation duration of each stator port 73*a*, 73*b* (i.e., the rotation of valve rotor 24 for which such stator port 73*a* or 73*b* is fully or partially open) may be greater than 120 degrees, preferably greater than 150 degrees, and most preferably about 180 degrees. The embodiment illustrated in FIG. 23 provides a theoretical activation duration of about 180 degrees. Second stator port 73*b* is partially or fully open from the time that side boundary 118 of rotor port 56 crosses the first side boundary of second stator port 73*b* (immediately after the position illustrated in FIG. 23C) until the time that side boundary 116 crosses the second side boundary of second stator port 73*b* (immediately before FIG. 23J).

Figure 24:
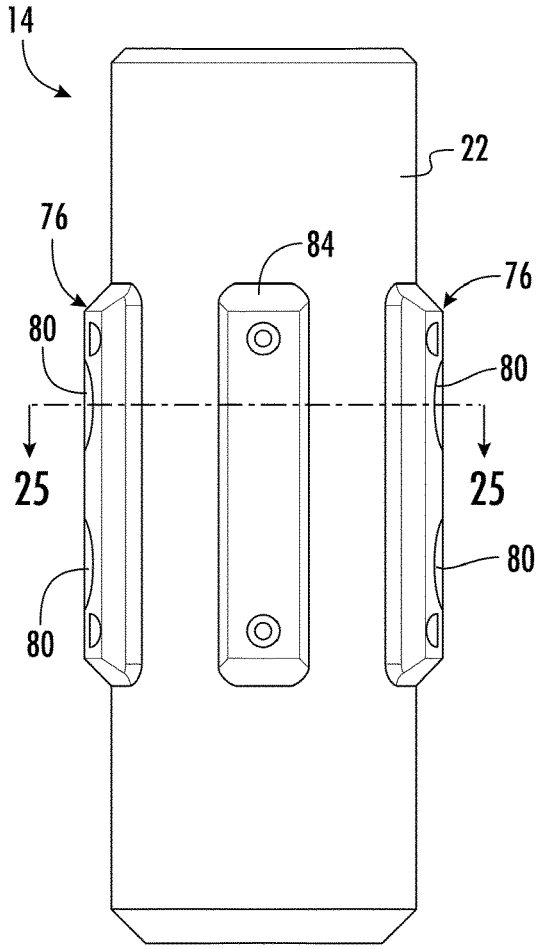
FIG. 24 is a side view of the steering section in a default position.
Figure 25:
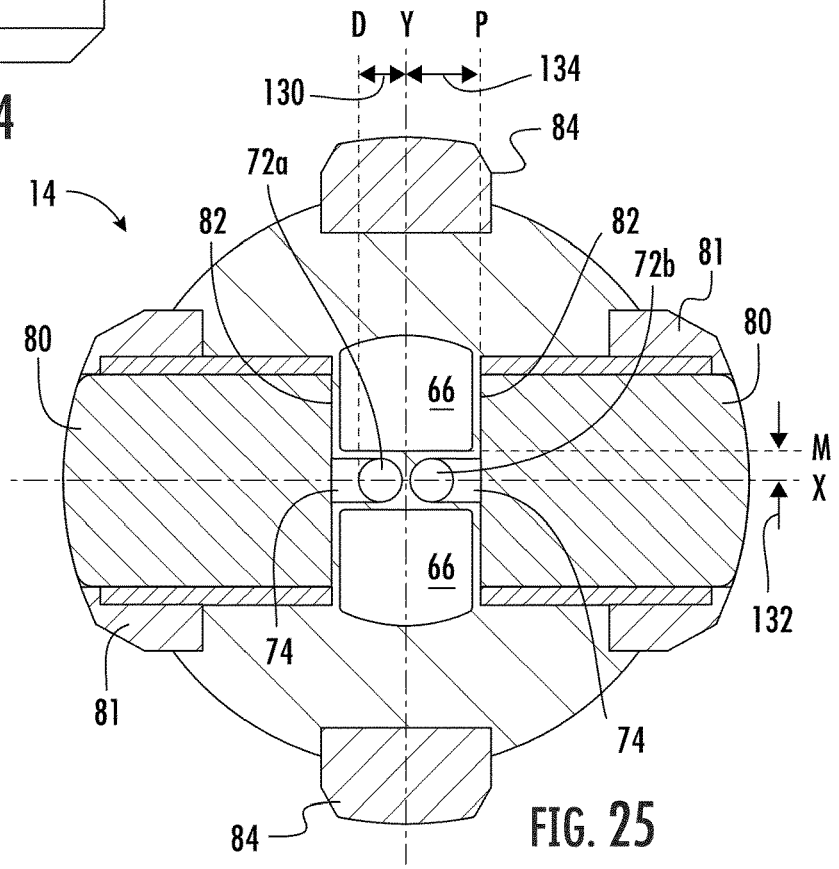
FIG. 25 is a sectional view of the steering section in the default position, taken along line 25-25 in FIG. 24.

FIGS. 24 and 25 illustrate steering section 14 in a default position in which pistons 80 are in retracted positions. This embodiment of rotary steerable system 10 includes two pistons 80, with the center points of the two pistons 80 separated by about 180 degrees. Because steering section 14 includes only two pistons 80 in each transverse cross-sectional plane, distribution flow passages 72*a* and 72*b* may be positioned within a central area of steering housing 22. In some embodiments, main flow passages 66 may extend from the central area outward radially. Distribution flow passages 72*a*, 72*b* and main flow passages 66 may be positioned between piston receptacles 82. Optionally, main flow passages 66 may also extend beyond the space between piston receptacles 82. The position of the distribution flow passages 72*a*, 72*b* in the central area within the same transverse cross-sectional plane as pistons 80 eliminates the need for a spider to rearrange flow lines through a length of the steering unit (i.e., distribution flow passages remain in the central area from the valve assembly 124 to the feed channels 74 and pistons 80).

In certain embodiments, the central area may be defined by a circular path that includes the center of the inner boundary of each piston receptacle 82 and is centered on the center of the steering section 14. In other embodiments, the central area may be defined by a central diameter surrounding the center of the steering section 14. The central diameter may be in the range of 1.5 inches to 3.0 inches, preferably about 1.75 inches to about 2.5 inches, or any subrange therein. In certain embodiments, the central diameter may be about 1.75 inches in a steering unit having a diameter less than or equal to 5.25 inches, about 2 inches in a steering unit having a diameter less than or equal to 6.75 inches, and about 2.5 inches in a steering unit having a diameter less than or equal to 9 inches. A ratio of the central diameter to the steering section diameter may be 0.5 or less, 0.4 or less, preferably 0.33 or less, more preferably 0.3 or less.

In the embodiment illustrated in FIG. 25, steering section 14 includes axis x and axis y intersecting at the central point of steering section 14 as shown. The central area in which distribution flow passages 72 are positioned is defined by distribution distance 130 between the central point and a line D extending from an outer most point on one of the distribution flow passages 72. Line M is defined by the inner boundary of one of the main flow passages 66. Line M is spaced apart from the central point by main distance 132. Line P is defined by the inner boundary of one of the piston receptacles 82. Line P is spaced apart from the central point by piston distance 134. In this embodiment, distribution distance 130 is greater than main distance 132, and piston distance 134 is greater than distribution distance 130. In other words, at least a portion of each main flow passage 66 is closer to the central point of the steering section than the outer boundary of the distribution flow passages 72. Additionally, at least a portion of each main flow passage 66 is closer to the central point of the steering section than the inner boundary of the piston receptacle 82 and the position of the piston in its retracted position.

The rotary steerable system disclosed herein includes distribution flow passages 72*a*, 72*b* having larger diameters and main flow passages 66 having larger diameters than in conventional rotary steerable systems. The larger diameters of these flow lines reduce the fluid flow speed, prevent a water hammer effect, reduce erosion, and reduce pressure drop in order to preserve energy. A ratio of a diameter of each distribution flow passage 72*a*, 72*b* to a diameter of steering section 14 may be at least 0.07. In certain embodiments, a diameter of each distribution flow passage 72*a*, 72*b* is about 0.35 inches in a steering section 14 having a diameter of at least 5.25 inches, about 0.5 inches in a steering section 14 having a diameter of at least 6.75 inches, and about 0.67 inches in a steering section 14 having a diameter of at least 9 inches.

With reference to FIGS. 10, 13, and 20-23, valve assembly 124 (shown in FIGS. 20-23) may be positioned at the upper end of the distribution flow passages (shown in FIG. 10) such that circular openings 96 on the second side 98 of stator ports 73 (shown in FIG. 13) align with distribution flow passages 72. Specifically, circular opening 96 of stator port 73*a* aligns with distribution flow passage 72*a*, and circular opening 96 of stator port 73*b* aligns with distribution flow passage 72*b*. As valve rotor 24 rotates relative to valve stator 26 (as shown in FIG. 23), stator ports 73*a* and 73*b* circulate through fully open, partially open, and closed positions, thereby directing fluid flowing through inner space 48 within housing 45 of lower control unit 32 into first distribution flow passage 72*a*, second distribution flow passage 72*b*, or a combination thereof.

Figure 26:
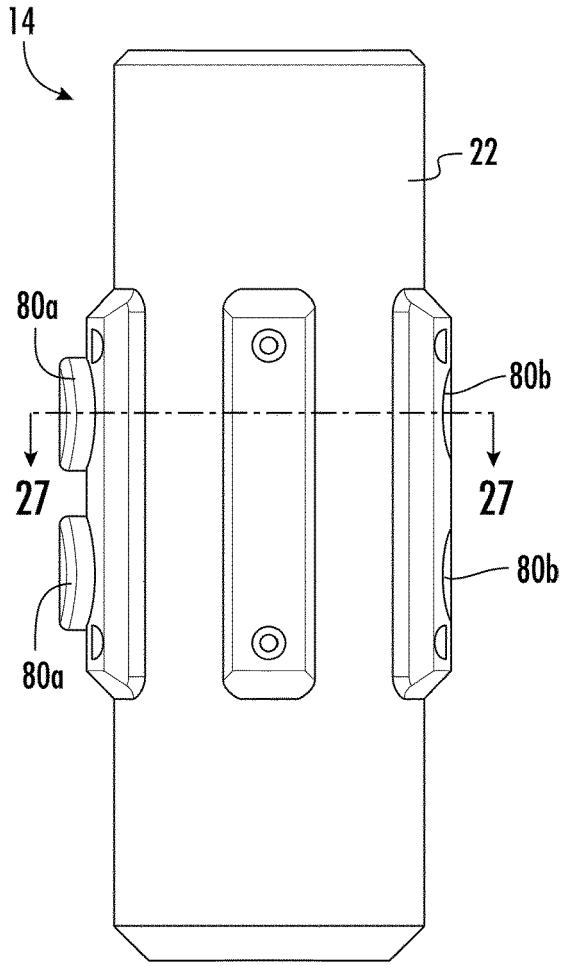
FIG. 26 is a side view of the steering section in a first extended position.
Figure 27:
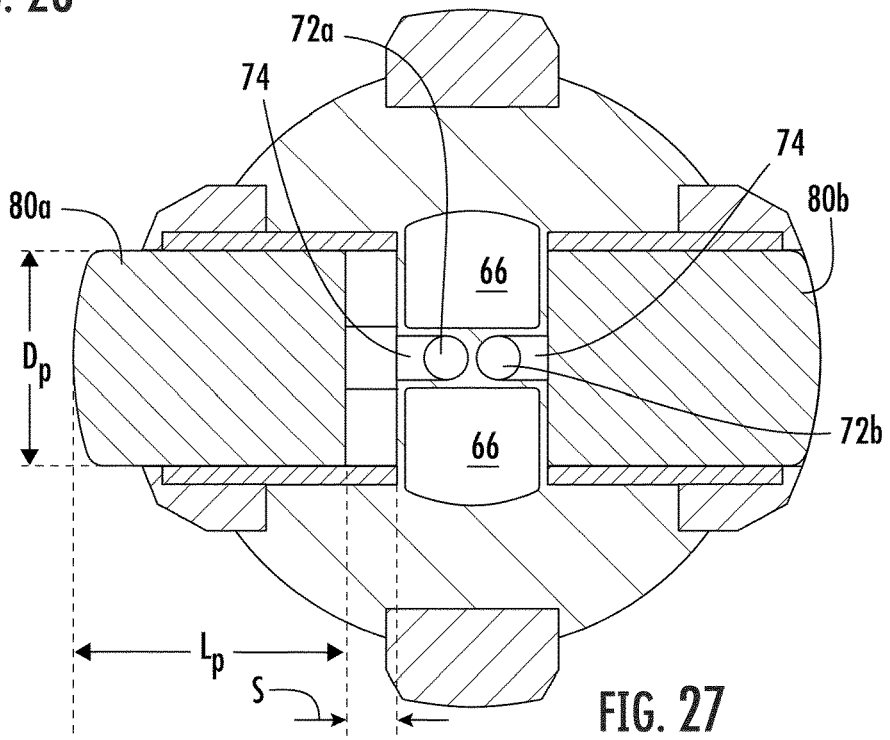
FIG. 27 is a sectional view of the steering section in the first extended position, taken along line 27-27 in FIG. 26.

FIGS. 26 and 27 illustrate steering section 14 in a first extended position when first stator port 73*a* is fully open (as shown in FIGS. 23A and 23B). In this position, valve assembly 124 directs the fluid within inner space 48 of lower control unit 32 into first distribution flow passage 72*a*. Specifically, the drilling fluid that has entered inner space 48 of lower control unit 32 flows through rotor port 56 of valve rotor 24, through first stator port 73*a*, through first distribution flow passage 72*a*, through feed channels 74, and into first piston receptacles 82*a*. The fluid flowing into first piston receptacles 82*a* applies a radial outward force on first pistons 80*a*, thereby causing first pistons 80*a* to move in a radially outward direction. In this first extended position, first pistons 80*a* may engage a wall of a wellbore being drilled through a subterranean formation in order to adjust the direction in which the wellbore is drilled further. The drilling fluid that flows through the spaces in impeller 40 flows through main flow passages 66, thereby bypassing the piston assemblies 76.

Referring again to FIG. 27, each piston 80*a* and 80*b* may have a length of $L_p$ and a diameter of $D_p$. In some embodiments a ratio of each piston's length to the piston's width is between 1 and 1.4, preferably between 1.1 and 1.3, or any subrange therein. For example, each of the pistons may have a length of 2.09 inches and a diameter of 1.73 inches, resulting in a ratio of about 1.2. In another example, the pistons may have a length of 2.88 inches and a diameter of 2.43 inches, resulting in a ratio of about 1.2. In yet another example, the pistons may have a length of 3.78 inches and a diameter of 3.12 inches, resulting in a ratio of about 1.2.

Figure 28:
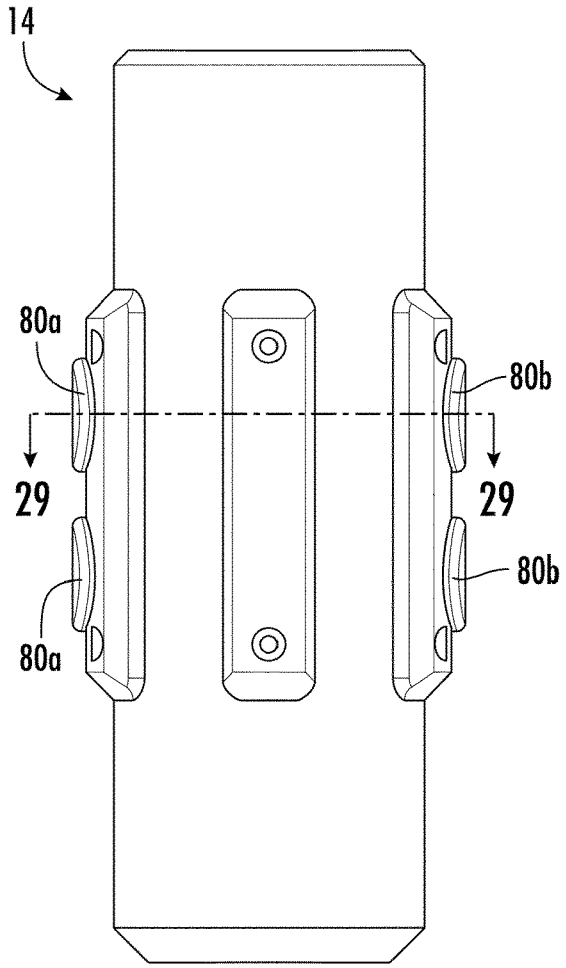
FIG. 28 is a side view of the steering section in a neutral position.
Figure 29:
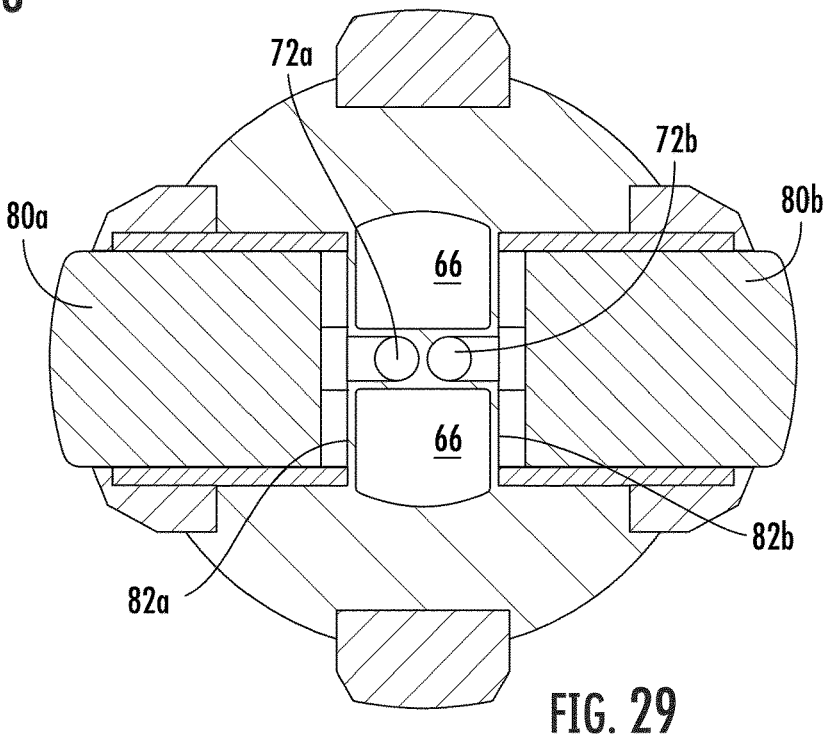
FIG. 29 is a sectional view of the steering section in the neutral position, taken along line 29-29 in FIG. 28.

Additionally, each piston 80*a* and 80*b* extends a stroke length S from its default position when activated. The pistons may have a ratio of stroke length to piston diameter that is greater than 0.06, preferably greater than 0.7, or about 0.08. For example, the stroke length of the piston may be between 0.3 inches and 0.5 inches in an embodiment having a steering section diameter of at least 5.25 inches. In another example, the stroke length of the piston may be between 0.4 inches and 0.6 inches in an embodiment having a steering section diameter of at least 6.75 inches. In yet another example, the stroke length of the piston may be between 0.6 inches and 0.8 inches in an embodiment having a steering section diameter of at least 9 inches FIGS. 28 and 29 illustrate steering section 14 in a neutral position when first and second stator ports 73*a*, 73*b* are both partially open (as shown in FIGS. 23D and 23I). In this position, valve assembly 124 directs the fluid within inner space 48 of lower control unit 32 into both first and second distribution flow passages 72*a*, 72*b*. As the fluid flow through first stator ports 73*a* and ultimately into piston receptacles 82*a* decreases, a force exerted by a wall of a wellbore on pistons 80*a* may overcome the outward force of the fluid flow into piston receptacles 82*a*, which may force pistons 80*a* to retract in a radially inward direction into piston receptacles 82*a*. The excess fluid in receptacle 82*a* is expelled through the exhaust port. Simultaneously, the drilling fluid flowing through second stator port 73*b* flows through second distribution flow passage 72*b*, through feed channels 74, and into piston receptacles 82*b*. The fluid flowing into piston receptacles 82*b* begins to apply a radial outward force on second pistons 80*b*, thereby causing second pistons 80*b* to begin moving in a radially outward direction.

Figure 30:
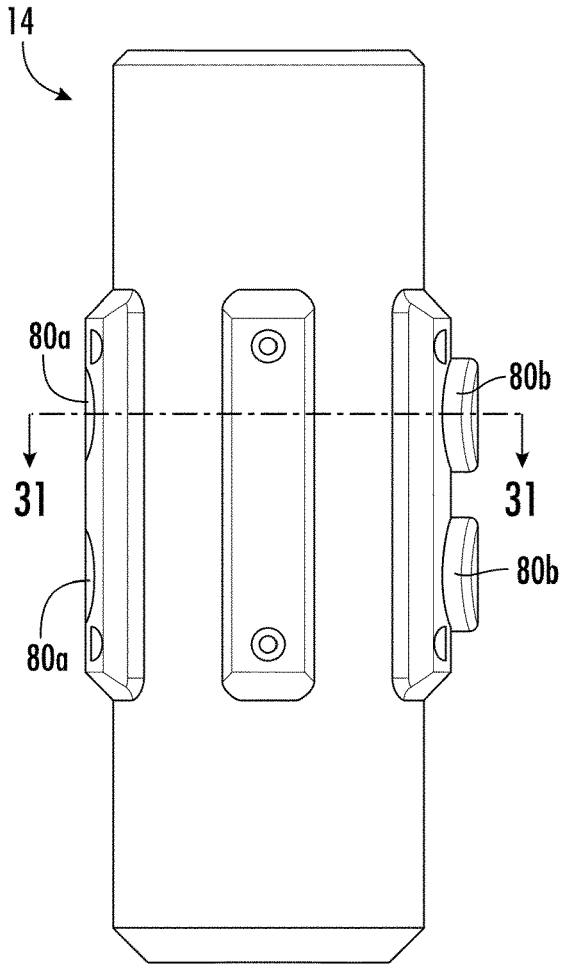
FIG. 30 is a side view of the steering section in a second extended position.
Figure 31:
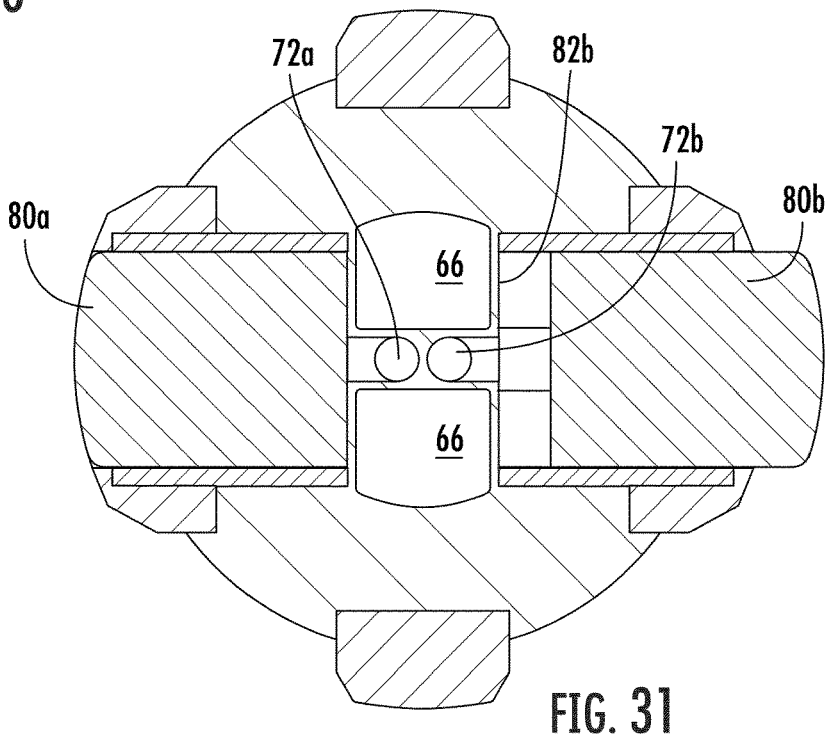
FIG. 31 is a sectional view of the steering section in the second extended position, taken along line 31-31 in FIG. 30.
Figure 32:
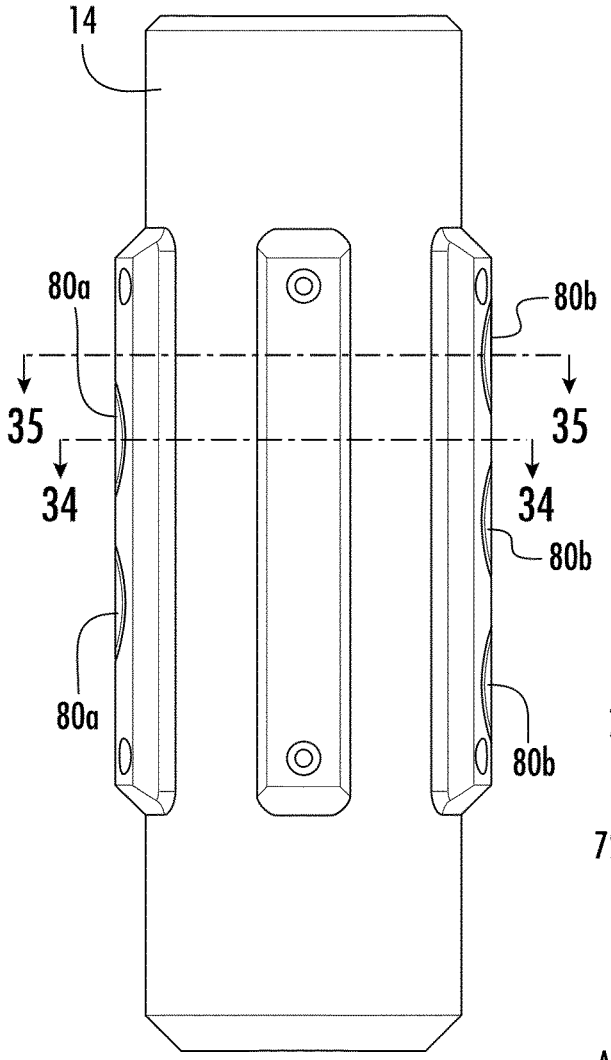
FIG. 32 is a side view of an alternate embodiment of the steering section.

FIGS. 30 and 31 illustrate steering section 14 in a second extended position when second stator port 73*b* is fully open (as shown in FIGS. 23F and 23G). In this position, valve assembly 124 directs all fluid within inner space 48 of lower control unit 32 into second distribution flow passage 72*b*. As the fluid flow through second stator ports 73*b* and ultimately into piston receptacles 82*b* increases, the fluid flow applies a greater radial outward force on second pistons 80*b*, thereby causing second pistons 80*b* to fully extend in the radially outward direction. In this second extended position, second pistons 80*b* may engage the wall of the wellbore in order to adjust the drilling in an opposite direction. In all positions of the steering section 14, the drilling fluid that flows through the spaces in impeller 40 flows through main flow passages 66, thereby bypassing the piston assemblies 76.

The theoretical activation duration of each piston 80*a*, 80*b* (i.e., the rotation of valve rotor 24 for which each piston 80*a*, 80*b* is fully or partially extended) is equivalent to the theoretical activation duration of each stator port 73*a*, 73*b*, which is discussed above. Rotary steerable system 10 may be configured to provide a theoretical activation duration of each piston 80*a*, 80*b* that is greater than 120 degrees, preferably greater than 150 degrees, and most preferably about 180 degrees. The actual observed activation duration of each piston 80*a*, 80*b* may be less than the theoretical activation duration because of actuation timing delays. As used herein, "activation duration" means the angle of rotation of valve rotor 24 during which a specified component is activated by or receives by fluid flow. The two-piston configuration of the rotary steerable system disclosed herein may provide a greater activation duration of each piston as compared to conventional rotary steerable systems including three-piston configurations due to fewer transitions in each rotation of the valve and due to larger angular separation of the side boundaries of each stator port.

Figure 33:
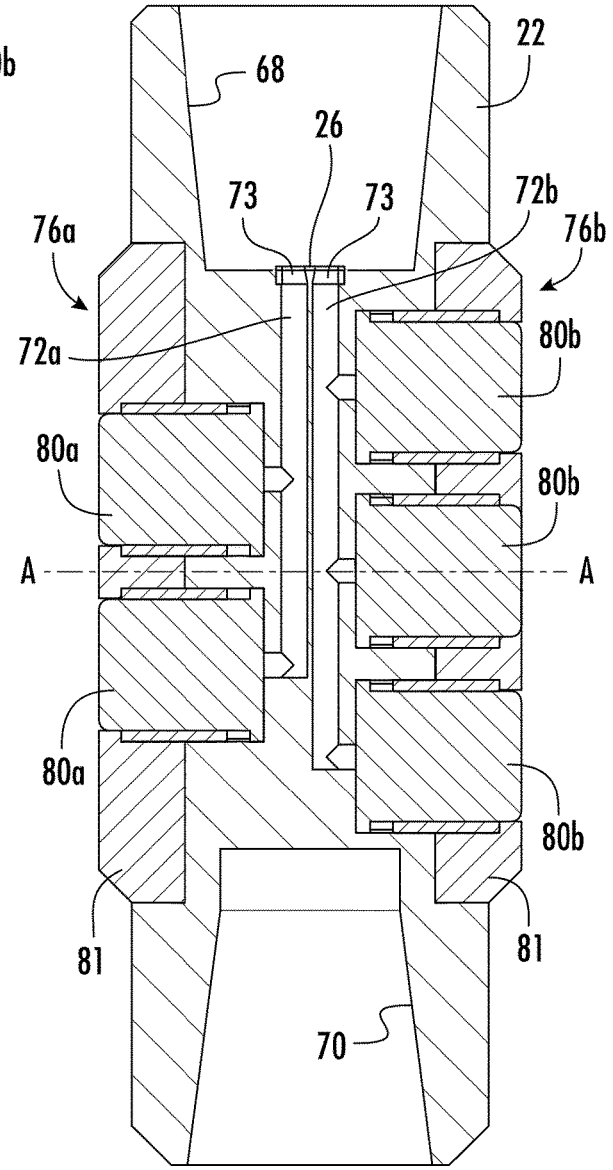
FIG. 33 is a sectional view of the alternate embodiment of the steering section.
Figure 34:
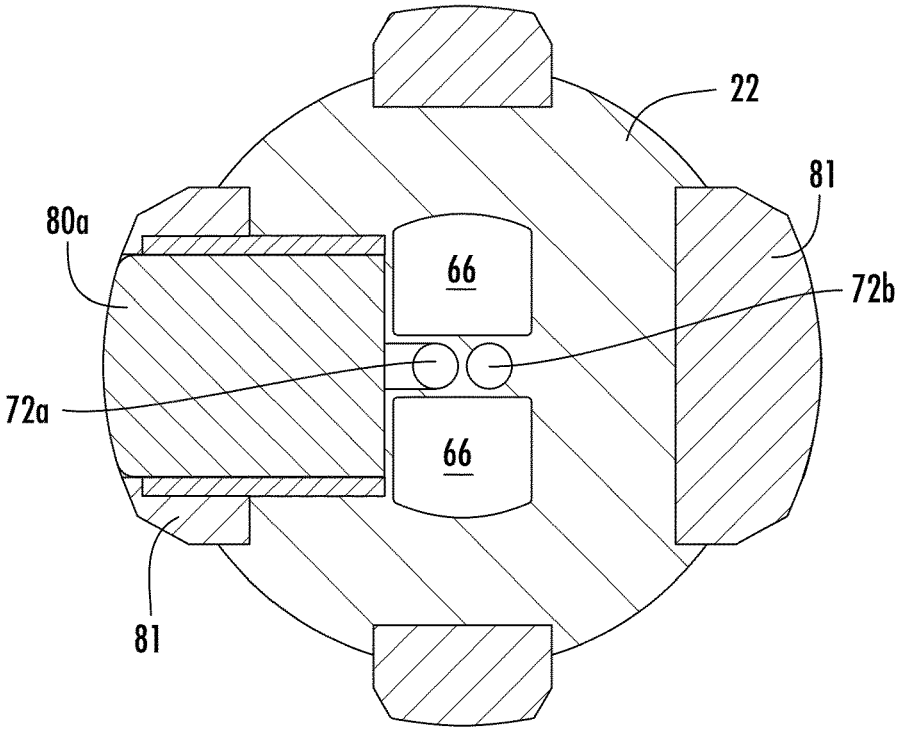
FIG. 34 is a sectional view of the alternate embodiment of the steering section taken along line 34-34 in FIG. 32.
Figure 35:
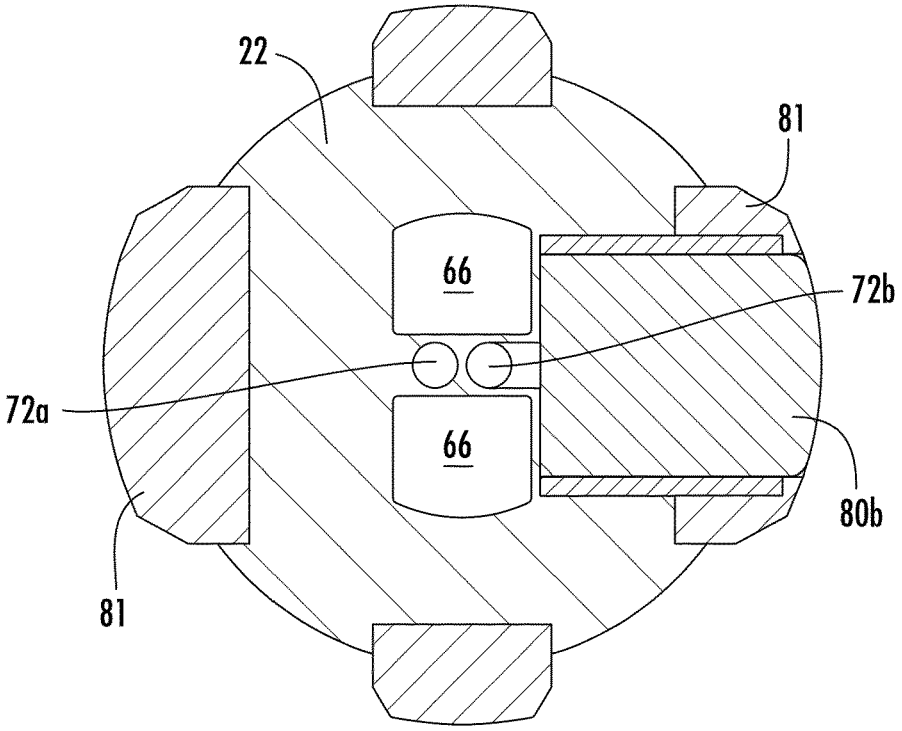
FIG. 35 is a sectional view of the alternate embodiment of the steering section taken along line 35-35 in FIG. 32.

Steering section 14 may include any number of pistons within the piston assemblies. In this embodiment illustrated in FIGS. 32-35, steering section 14 includes a first piston assembly 76*a* including two pistons 80*a* and a second piston assembly 76*b* including three pistons 80*b*. In the illustrated embodiment pistons 80*a* may be staggered along the axial length of steering housing 22 relative to pistons 80*b*, as shown in FIG. 33. In other words, the steering section 14 includes only one piston in a transverse cross-sectional plane, such as plane A-A. In other embodiments, the offset pistons are separated by a length that is equal to the steering section diameter. Alternatively, the steering section 14 may include only a one piston.

Figure 36:
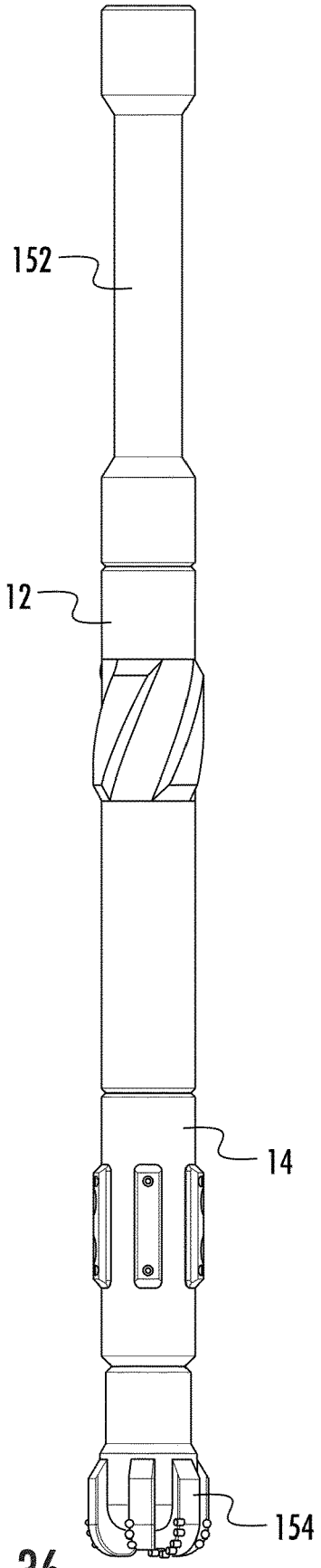
FIG. 36 is a side view of the rotary steerable system connected between a flex shaft and a drill bit.
Figure 37:
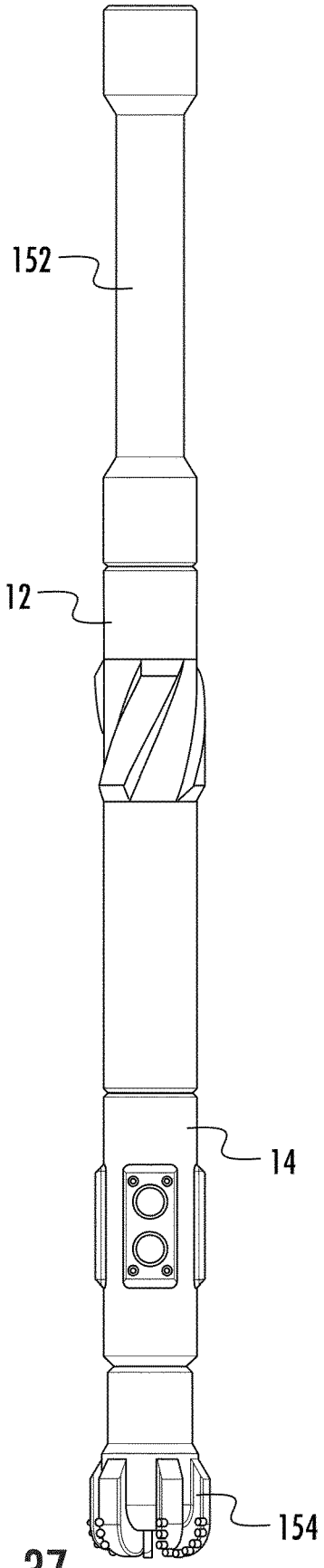
FIG. 37 is another side view of the rotary steerable system connected between the flex shaft and the drill bit.

Referring now to FIGS. 36 and 37, rotary steerable system 10 may be secured below flex shaft 152 and drill bit 154 in a bottom hole assembly.

The rotary steerable system of the present invention, which includes a steering section and a control section, is significantly shorter than conventional rotary steerable systems. The combined length of the steering section and the control section is less than 150 inches, less than 125 inches, less than 100 inches, less than 80 inches, less than 75 inches, less than 70 inches, less than 65 inches, or any subrange therein. In one embodiment, the rotary steerable system has a minimum diameter of about 5.25 inches, and a combined length of about 63 inches. In another embodiment, the rotary steerable system has a minimum diameter of about 6.75 inches, and a combined length of about 67 inches. In still another embodiment, the rotary steerable system has a minimum diameter of about 9 inches, and a combined length of about 74 inches.

Alternatively, the rotary steerable system has a length to steering section diameter ratio of less than 16, less than 14, less than 11, less than 10, less than 9, or any subrange therein. As used herein, "length to steering section diameter ratio" means a ratio of the combined length of the steering section and control section to the minimum outer diameter of the steering section or the control section (in inches). For example, but not by way of limitation, the rotary steerable system may have a diameter less than or equal to 5.25 inches, and a length to steering section diameter ratio of less than 13, less than 12, or any subrange therein. Alternatively, the rotary steerable system may have a diameter less than or equal to 6.75 inches, and a length to steering section diameter ratio of less than 11, less than 10, or any subrange therein. In other embodiments, the rotary steerable system may have a diameter less than or equal to 9 inches, and a length to steering section diameter ratio of less than 9.

With reference again to FIGS. 36 and 37, flex shaft 152 may be secured above rotary steerable system 10, and drill bit 154 may be secured below rotary steerable system 10. The reduced length of the rotary steerable system 10 positions flex shaft 152 closer to drill bit 154 than in conventional rotary steerable systems, thereby enabling the rotary steerable system to turn the drill bit path by a smaller radius. For example, the rotary steerable system disclosed herein may enable a maximum turn rate of 14 degrees per 100 feet. In another embodiment, the rotary steerable system disclosed herein may enable a maximum turn rate of 18 degrees per 100 feet. In yet another embodiment, the rotary steerable system disclosed herein may enable a maximum turn rate of 24 degrees per 100 feet. In effect, the reduced length rotary steerable system 10 behaves as a hybrid push-the-bit/point-the-bit system as control section 12 and steering section 14 are deflected (i.e., pushed) as one and become pointed in the desired direction. The maximum turn rate values may be affected by environmental conditions, including conditions within a wellbore or conditions of a subterranean formation.

The reduced length of the rotary steerable system of the present invention is achieved due to several features. For example, lower filter 49 and valve assembly including valve rotor 24 and valve stator 26 are incorporated into a single module, as shown in FIG. 10. In contrast, conventional rotary steerable systems include separate modules for filters and valves. Additionally, the absence of a battery reduces the length of control section 12. Another example is the use of smaller memory components, such as micro-electromechanical systems ("MEMS"), in the control section 12. Conventional rotary steerable systems teach away from smaller memory components in favor of larger memory components capable of storing data required for well surveys. Further, the rotary steerable system disclosed herein includes only three sensors in control section 12, thereby reducing the length of the control section 12. Conventional rotary steerable systems include a greater number of sensors, which require a greater length of the control section. Another example is the transition of the shape of stator ports 73 across the thickness of valve stator 26, which reduces the length of transition flow lines needed in steering housing 22 between the valve assembly and the pistons 80. Furthermore, the central position of distribution flow passages 72 within steering section 14 eliminates the requirement for a spider, which transposes the main flow and distribution flow lines between the valve and pistons in conventional rotary steerable systems.

The reduced length of the rotary steerable system disclosed herein provides the commercial advantage of requiring less material for construction, thereby reducing costs of manufacturing and maintenance. In some embodiments, the components of the rotary steerable system disclosed herein are more accessible from outside of the rotary steerable system, which enables users to perform certain additional maintenance tasks in any location without the need for transporting the rotary steerable system to a shop.

In other embodiments, the rotary steerable system of the present invention includes only a steering section without a control section. In this embodiment, the elements of the control section may be incorporated into the steering section, positioned in adjacent devices in the drill string, eliminated, or any combination thereof.

As illustrated in FIGS. 2-9, the rotary steerable system disclosed herein, such as rotary steerable system 10, includes nine modules, with each module comprising a unit that may be maintained, assembled, disassembled, or exchanged independently of the other modules. The modules of the rotary steerable system disclosed herein are listed in Table 2 below.

TABLE 2

| | |
|---|---|
| Modules of steering section 14 | Steering housing 22 |
| | Pistons 80 |
| | Piston clamps 81 |
| | Spacers 84 |
| | Screw sets for spacers 84 |
| Modules of control section 12 | Control sleeve 16 |
| | Guides 34, 36 with bolts |
| | Electronics 30, lower control unit 32, and inner portions of upper control unit 28 |
| | Housing of upper control unit 28 |

As used herein, "upper" and "lower" are to be interpreted broadly to include "proximal" and "distal" such that the structures may not be positioned in a vertical arrangement. Additionally, the elements described as "upper" and "lower" may be reversed such that the structures may be configured in the opposite vertical arrangement.

Except as otherwise described or illustrated, each of the components in this device has a generally cylindrical shape and may be formed of steel, another metal, or any other durable material. Portions of the rotary steerable system may be formed of a wear resistant material, such as tungsten carbide or ceramic coated steel.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A rotary steerable system, comprising:

a steering section, wherein the steering section has a transverse cross-sectional plane extending across a width of the steering section and that plane includes at least two pistons;

a control section; and a valve assembly including a valve stator and a valve rotor; wherein the valve stator is rotationally secured to the steering section, and wherein the valve rotor rotates relative to the valve stator and the steering section; wherein the valve stator includes two stator ports each transitioning from a wedge-shaped opening into a second opening across a thickness of the valve stator; wherein the second opening has a different shape than the wedge-shaped opening;

wherein the steering section includes at least two distribution flow passages, each of the distribution flow passages extending from one of the respective stator ports to one of the respective pistons; wherein the steering section further includes two main flow passages radially spaced apart from a central point of the steering section and bypassing the pistons; wherein each of the two main flow passages extends parallel to the other from an upper inner bore of the steering section to a lower inner bore of the steering section.

2. The rotary steerable system of claim 1, wherein the second opening is a circular opening.

3. The rotary steerable system of claim 1, wherein the second opening is a polygon-shaped opening.

4. The rotary steerable system of claim 1, wherein a portion of each main flow passage is closer to the central point of the steering section than an inner boundary of the pistons in the retracted position.

5. The rotary steerable system of claim 1, wherein a portion of each main flow passage is closer to the central point of the steering section than an outer boundary of each distribution flow passage.

6. The rotary steerable system of claim 1, wherein the at least two pistons comprises two sets of pistons, wherein each set of pistons includes two or more angularly aligned pistons.

7. The rotary steerable system of claim 1, wherein the duration for which one of the at least two pistons is activated is greater than 110 degrees of rotation of the valve rotor.

8. The rotary steerable system of claim 1, wherein the duration for which one of the at least two pistons is activated is greater than 120 degrees of rotation of the valve rotor.

9. The rotary steerable system of claim 1, wherein the duration for which one of the at least two pistons is activated is about 150 degrees of rotation of the valve rotor.

* * * * *